US009562677B2

(12) United States Patent
Negley et al.

(10) Patent No.: US 9,562,677 B2
(45) Date of Patent: Feb. 7, 2017

(54) LED LAMP HAVING AT LEAST TWO SECTORS

(71) Applicant: Cree, Inc., Durham, NC (US)

(72) Inventors: Gerald H. Negley, Chapel Hill, NC (US); Matthew C. Reynolds, Chapel Hill, NC (US); Curt Progl, Raleigh, NC (US)

(73) Assignee: Cree, Inc., Durham, NC (US)

( * ) Notice: Subject to any disclaimer, the term of this patent is extended or adjusted under 35 U.S.C. 154(b) by 2 days.

(21) Appl. No.: 14/292,387

(22) Filed: May 30, 2014

(65) Prior Publication Data

US 2015/0292686 A1 Oct. 15, 2015

Related U.S. Application Data

(60) Provisional application No. 61/977,263, filed on Apr. 9, 2014.

(51) Int. Cl.

| | |
|---|---|
| ***F21V 21/00*** | (2006.01) |
| ***F21V 23/00*** | (2015.01) |
| ***H05B 37/02*** | (2006.01) |
| ***F21V 29/83*** | (2015.01) |
| ***F21V 3/04*** | (2006.01) |
| ***F21V 29/506*** | (2015.01) |
| ***F21V 29/85*** | (2015.01) |
| *F21Y 101/00* | (2016.01) |

(52) U.S. Cl.

CPC ..... *F21V 23/009* (2013.01); *F21K 9/23* (2016.08); *F21K 9/232* (2016.08); *F21K 9/62* (2016.08); *F21V 3/049* (2013.01); *F21V 3/0445* (2013.01); *F21V 23/005* (2013.01); *F21V 29/506* (2015.01); *F21V 29/83* (2015.01); *F21V 29/85* (2015.01); *H05B 37/0272* (2013.01); *F21Y 2101/00* (2013.01); *F21Y 2107/00* (2016.08); *F21Y 2115/10* (2016.08)

(58) Field of Classification Search

CPC ..... F21Y 2111/001; F21Y 2111/002; F21Y 2111/004

USPC ..... 315/34, 51; 362/249.01, 249.02, 296.01, 362/297, 310, 311.01, 311.02, 363

See application file for complete search history.

(56) References Cited

U.S. PATENT DOCUMENTS 3,581,162 A 5/1971 Wheatley
5,463,280 A 10/1995 Johnson
(Continued)

FOREIGN PATENT DOCUMENTS

EP 1058221 A2 12/2000
EP 0890059 B1 6/2004
(Continued)

OTHER PUBLICATIONS

U.S. Appl. No. 13/462,388, filed May 2, 2012.
(Continued)

*Primary Examiner* — Thuy Vinh Tran
(74) *Attorney, Agent, or Firm* — Dennis J. Williamson; Moore & Van Allen PLLC

(57) ABSTRACT

A lamp comprises an interior space and a base. An enclosure may be connected to the base to enclose the interior space. At least one LED board divides the interior space into a plurality of sectors. An LED is located in each sector in the enclosure operable to emit light when energized through an electrical path from the base. Light from the LED is reflected by a wall of the sector to create a reflected light source.

23 Claims, 33 Drawing Sheets

(56) References Cited

U.S. PATENT DOCUMENTS

| | | | |
|---|---|---|---|
| 5,561,346 | A | 10/1996 | Byrne |
| 5,575,459 | A | 11/1996 | Anderson |
| 5,585,783 | A | 12/1996 | Hall |
| 5,655,830 | A | 8/1997 | Ruskouski |
| 5,688,042 | A | 11/1997 | Madadi et al. |
| 5,726,535 | A | 3/1998 | Yan |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Ichikawa et al. |
| 6,623,151 | B2 | 9/2003 | Pederson |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin et al. |
| 6,948,829 | B2 | 9/2005 | Verdes et al. |
| 6,982,518 | B2 | 1/2006 | Chou et al. |
| 7,048,412 | B2 | 5/2006 | Martin et al. |
| 7,049,746 | B2 | 5/2006 | Mano et al. |
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,726,836 | B2 | 6/2010 | Chen |
| 7,824,065 | B2 | 11/2010 | Maxik |
| 7,964,883 | B2 | 6/2011 | Mazzochette et al. |
| 8,021,025 | B2 | 9/2011 | Lee |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,371,722 | B2 | 2/2013 | Carroll |
| 8,400,051 | B2 | 3/2013 | Hakata et al. |
| 8,408,748 | B2 | 4/2013 | Janik et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,421,329 | B2 | 4/2013 | Liang et al. |
| 8,449,154 | B2 | 5/2013 | Uemoto et al. |
| 8,502,468 | B2 | 8/2013 | Li et al. |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 9,010,964 | B2 * | 4/2015 | Wang ..... 362/241 |
| 9,016,901 | B2 | 4/2015 | Janik et al. |
| 9,103,511 | B2 * | 8/2015 | Catalano ..... F21V 7/06 |
| 2004/0201990 | A1 | 10/2004 | Meyer |
| 2005/0030761 | A1 | 2/2005 | Burgess |
| 2008/0174224 | A1 | 7/2008 | Liao et al. |
| 2009/0184618 | A1 | 7/2009 | Hakata et al. |
| 2011/0163683 | A1 | 7/2011 | Steele et al. |
| 2011/0273102 | A1 | 11/2011 | Van De Ven et al. |
| 2012/0040585 | A1 | 2/2012 | Huang |
| 2012/0127726 | A1 | 5/2012 | Yen |
| 2012/0162988 | A1 | 6/2012 | Marinus et al. |
| 2012/0193647 | A1 | 8/2012 | Andrews |
| 2013/0026923 | A1 | 1/2013 | Athalye et al. |
| 2013/0026925 | A1 | 1/2013 | Ven et al. |
| 2013/0069535 | A1 | 3/2013 | Athalye |
| 2013/0107531 | A1 * | 5/2013 | Breidenassel ..... F21K 9/135 362/249.02 |
| 2013/0127353 | A1 | 5/2013 | Athalye et al. |
| 2013/0162149 | A1 | 6/2013 | Van De Ven et al. |
| 2013/0162153 | A1 | 6/2013 | Van De Ven et al. |
| 2013/0169159 | A1 | 7/2013 | Lys |
| 2013/0235586 | A1 | 9/2013 | Gielen et al. |
| 2013/0293135 | A1 | 11/2013 | Hu et al. |
| 2013/0294092 | A1 * | 11/2013 | Hussell et al. ..... 362/363 |
| 2014/0043788 | A1 | 2/2014 | Gielen et al. |
| 2014/0103373 | A1 * | 4/2014 | Li ..... F21K 9/56 257/88 |
| 2014/0218909 | A1 * | 8/2014 | Tetsuo et al. ..... 362/231 |
| 2014/0292176 | A1 * | 10/2014 | Athalye ..... 313/46 |
| 2014/0301074 | A1 * | 10/2014 | Miskin ..... 362/235 |
| 2014/0327355 | A1 * | 11/2014 | Chen et al. ..... 315/34 |
| 2014/0368130 | A1 * | 12/2014 | Catalano ..... H05B 33/0884 315/309 |
| 2015/0009688 | A1 * | 1/2015 | Timmermans ..... F21K 9/17 362/362 |

FOREIGN PATENT DOCUMENTS

| | | | |
|---|---|---|---|
| EP | 2392851 | A1 | 7/2011 |
| EP | 2568216 | A2 | 3/2013 |
| GB | 2345954 | A | 7/2000 |
| JP | H09265807 | A | 10/1997 |
| JP | 2000173304 | A | 6/2000 |
| JP | 2001118403 | A | 4/2001 |
| JP | 2007059930 | A | 3/2007 |
| JP | 2008288183 | A | 11/2008 |
| JP | 2009117346 | A | 5/2009 |
| JP | 3153766 | U | 9/2009 |
| JP | 2009277586 | A | 11/2009 |
| TW | 201043861 | A | 12/2010 |
| TW | 201400743 | A | 1/2014 |
| WO | 0124583 | A1 | 4/2001 |
| WO | 0160119 | A2 | 8/2001 |
| WO | 2009/089529 | A1 | 7/2009 |
| WO | 2012011279 | A1 | 1/2012 |
| WO | 2012031533 | A1 | 3/2012 |

OTHER PUBLICATIONS

U.S. Appl. No. 14/284,643, filed May 22, 2014.
U.S. Appl. No. 14/292,286, filed May 30, 2014.
Cree, Inc., International Application No. PCT/US2015/023586, International Search Report and Written Opinion, May 29, 2015.
CREE, Inc., Taiwan Patent Application No. 104111272, Official Letter, Aug. 30, 2016.

* cited by examiner

LED LAMP HAVING AT LEAST TWO SECTORS

This application claims benefit of priority under 35 U.S.C. §119(e) to the filing date of U.S. Provisional Application No. 61/977,263, as filed on Apr. 9, 2014, which is incorporated herein by reference in its entirety.

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver reflectedly any color light, and generally contain no lead or mercury. A solid-state lighting system may take the form of a luminaire, lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and/or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A separate heatsink is also often needed to cool the LEDs and/or power supply in order to maintain appropriate operating temperature.

SUMMARY OF THE INVENTION

In some embodiments a lamp comprises an at least partially optically transmissive enclosure defining an interior space and a base connected to the enclosure. At least one board divides the interior space into at least two sectors. At least one LED is located in each of the at least two sectors in the enclosure and is operable to emit light when energized through an electrical path from the base. Each of the at least two sectors may be defined by at least by a LED board.

Each of the at least two sectors may be defined at least by a LED board and a portion of the enclosure. Each of the at least two sectors may be defined at least by a reflector board. The reflector board may comprise a reflective surface for reflecting light from the at least one LED. Each sector may be defined at least by a first LED board and a portion of the enclosure. Light emitted from the at least one LED located in each of the plurality of sectors may be emitted from the portion of the enclosure. The at least one LED board may be thermally dissipative. The at least one LED board may be electrically conductive. The at least one LED board may comprise a PCB FR4 board. The at least one LED board may comprise a metal core printed circuit board. The at least one LED board may form a part of the electrical path. The at least one LED board may dissipate heat from the at least one LED without a heat sink. The at least one LED board may comprise a large area of thermally conductive material. The at least one LED board may comprise an electrical circuit mounted on a substrate. The substrate may not be in the electrical path. The electrical circuit may comprise a flex circuit. The electrical circuit may comprise a lead frame. The substrate may comprise at least one of glass and metal. A portion of the at least one LED board may comprise a reflective surface. The reflective surface may be at least one of a refractive optic surface, a specular surface, a spreading surface and a diffuse reflective surface. The reflective surface may create a reflected light source from the at least one LED. Four sectors may be provided that divide the area inside of the enclosure into four approximately equal size three-dimensional spaces. Three sectors may be provided that divide the area inside of the enclosure into three approximately three equal size three-dimensional spaces. The at least one LED may be located in each of the plurality of sectors to emit some light directly out of the enclosure and to emit some light that is reflected from a reflective surface of the at least one LED board to create at least one reflected light source. The at least one LED board may be configured such that it extends close to an interior surface of the enclosure. The at least one LED board may comprise two LED boards that form four sectors. The enclosure may comprise apertures. At least a portion of the at least one LED board may be exposed to the exterior of the enclosure. The at least one LED board may comprise a planar rigid member. Lamp electronics may be mounted to the at least one LED board. The lamp electronics may be mounted in the base. A portion of the at least one LED board may be positioned in the base. The enclosure may comprise a reflector and an optically transmissive exit surface through which light is emitted from the lamp where the reflector generates a directional light pattern.

In some embodiments a lamp comprises a base and at least one LED board extending from the base to define a plurality of sectors. At least one LED is located in each of the plurality of sectors and is operable to emit light when energized through an electrical path from the base. A lens is disposed over each of the at least one LED. The lens may comprise a diffuser and/or a phosphor.

In some embodiments a lamp comprises an at least partially optically transmissive enclosure defining an interior space. A base is connected to the enclosure. At least one LED board divides the interior space into a plurality of sectors. At least one LED is located in each of the plurality of sectors in the enclosure. The LEDs are operable to emit light when energized through an electrical path from the base.

In some embodiments a lamp comprises an at least partially optically transmissive enclosure defining an interior space and a base connected to the enclosure. At least one LED is located in the enclosure and is operable to emit light when energized through an electrical path from the base. Lamp electronics control operation of the lamp. An antenna communicates with the lamp electronics.

In some embodiments a lamp comprises an at least partially optically transmissive enclosure defining an interior space and a base connected to the enclosure. At least one LED board extends into the interior space. At least one LED is supported on the LED board and is operable to emit light when energized through an electrical path from the base. At least one reflective surface extends into the interior space for reflecting light from the at least one LED.

In some embodiments a LED lamp comprises an at least partially optically transmissive enclosure defining an interior space and a base connected to the enclosure. At least one LED board divides the interior space into at least two sectors. At least one LED is located in each of the at least two sectors in the enclosure and is operable to emit light when energized through an electrical path from the base.

The base may comprise an Edison screw and the enclosure may comprise a plastic enclosure that is connected directly to the Edison screw. The inside surface of a portion of the enclosure adjacent the Edison screw may be mechanically diffusive to prevent visibility through the portion. The portion of the enclosure may be defined by a partition internal of the lamp. The lamp electronics may be disposed between the partition and the Edison screw. The enclosure may comprise a plastic enclosure having a polished finish exterior surface and a mechanically diffusive interior surface. The enclosure may comprise vent openings. A reinforcement member may connect the at least one LED board to the enclosure. The at least one LED board may be electrically coupled to the base by a first spring contact and a second spring contact.

In some embodiments a LED lamp comprises an at least partially optically transmissive enclosure defining an interior space and a base connected to the enclosure. A first LED board and a second LED board divide the interior space into at least two sectors. At least one LED is located in each of the at least two sectors in the enclosure and is operable to emit light when energized through an electrical path from the base.

The base may comprise an Edison screw and the enclosure may comprise a plastic enclosure that is connected directly to the Edison screw. The inside surface of a portion of the enclosure adjacent the Edison screw may be mechanically diffusive to prevent visibility through the portion. The portion of the enclosure may be defined by a partition internal of the lamp. The lamp electronics may be disposed between the partition and the Edison screw. The enclosure may comprise a plastic enclosure having a polished finish exterior surface and a mechanically diffusive interior surface. The enclosure may comprise vent openings. A reinforcement member may connect the first LED board to the second LED board. The enclosure may comprise vent openings and the reinforcement member may comprise blockers positioned internally of the enclosure that prevent direct line of sight to the at least one LED though the vent openings. The blockers may be light diffusive. A reinforcement member may connect the first LED board and the second LED board to the enclosure. The first LED board and the second LED board may divide the interior space into four sectors where two LEDs are located in each sector where a first one of the two LEDs in each sector is located on the first LED board and a second one of the two LEDs in each sector is located on the second LED board. The first LED board may be electrically coupled to the base by a first spring contact. The first LED board may be electrically coupled to the second LED board by a second spring contact.

DETAILED DESCRIPTION

Figure 1:
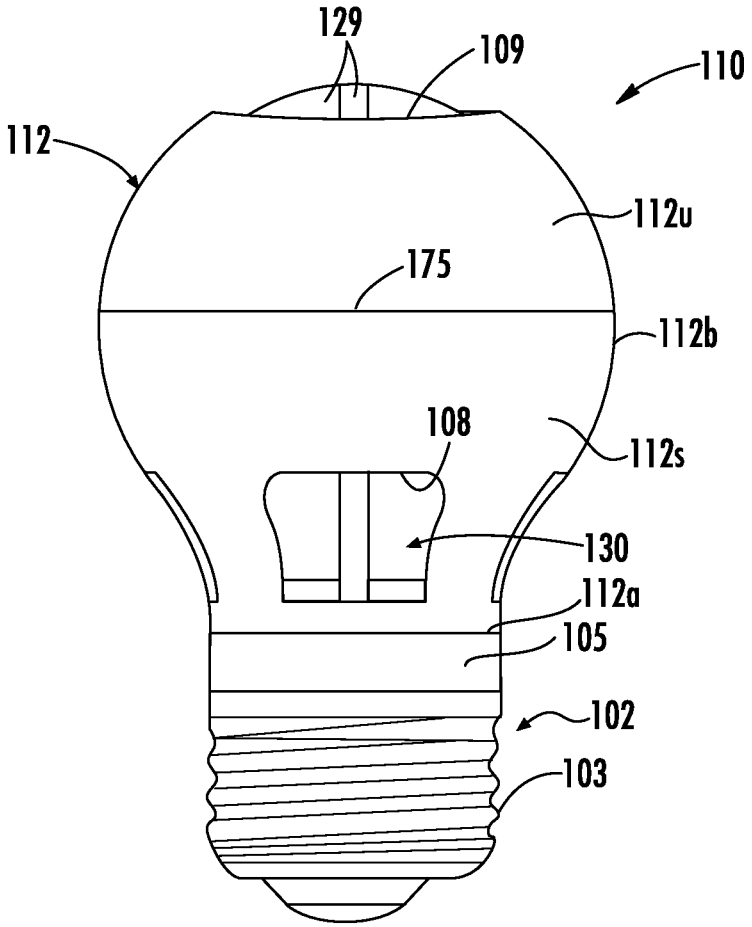
FIG. 1 is a plan view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

FIGS. 1, 2, 3 and 8 show a lamp, 100, according to some embodiments of the present invention embodied in a form factor of a traditional incandescent bulb. In an omnidirectional lamp such as lamp 100 the light is emitted in a wide omnidirectional pattern. In one embodiment, the enclosure and base are dimensioned to be a replacement for an ANSI standard A series bulb such that the dimensions of the lamp 100 fall within the ANSI standards for an A series bulb. In one embodiment, the lamp 100 is configured to be a replacement for an ANSI standard A19 bulb such that the dimensions of the lamp 100 fall within the ANSI standards for an A19 bulb. The dimensions may be different for other ANSI standards including, but not limited to, A21 and A23 standards. In the lamp 100, light is emitted from the lamp in an omnidirectional pattern and in one embodiment the lamp may comply with "ENERGY STAR® Program Requirements for Integral LED Lamps". The lamp may be equivalent to a 40 W, 60 W, 75 W or 100 W bulb or it may be equivalent to other wattages.

Figure 17:
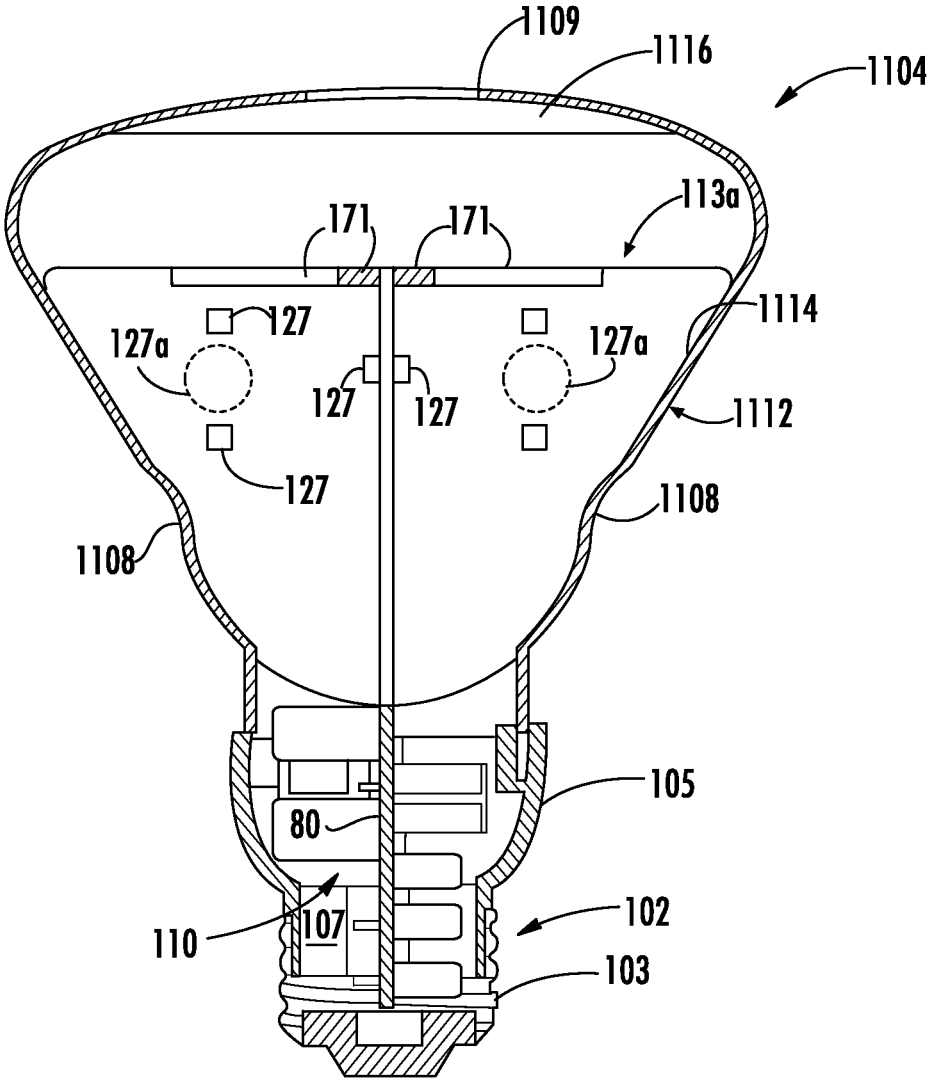
FIG. 17 is a section view of another embodiment of the lamp of the invention.

In other embodiments the lamp 1100 may be dimensioned to be a replacement for a standard PAR incandescent bulb, such as a PAR-20, 30 or 38 bulb, or a BR-style lamp, such as a BR30, as shown in FIG. 17. In some embodiments, the enclosure and base are dimensioned such that the dimensions of the lamp 1100 fall within the ANSI standards for a PAR or BR series bulb. Standard BR type bulbs are reflector bulbs where an internal reflective surface of the enclosure reflects light such that the light beam is emitted in a directional pattern; however, the beam angle is not tightly controlled and may be up to about 90-100 degrees or other fairly wide angles. Standard PAR bulbs are reflector bulbs that reflect light in a direction where the reflective surface is a parabola and the beam angle is tightly controlled. PAR lamps may direct the light in a pattern having a tightly controlled beam angle such as, but not limited to, 10°, 25° and 40°.

The lamp of the invention may be embodied in different forms including standard and non-standard form factors. In other embodiments, the LED lamp can have any shape, including standard and non-standard shapes. In some embodiments, the LED lamp may be equivalent to standard watt incandescent light bulbs such as, but not limited to, 40 Watt, 60 Watt, 100 Watt or other wattages.

Lamp 100 may be used with an Edison base 102. A lamp base, such as the Edison base 102, functions as the electrical connector to connect the lamp 100 to an electrical socket or other power source. Depending on the embodiment, other base configurations are possible to make the electrical connection such as other standard bases or non-standard bases. The base 102 comprises an electrically conductive Edison screw 103 for connecting to an Edison socket and may comprise a housing 105 connected to the Edison screw 103. The Edison screw 103 may be connected to the housing 105 by adhesive, mechanical connector, welding, separate fasteners or the like. The housing 105 may be made of an electrically insulating material such as plastic. In some embodiments the housing 105 may comprise a thermally conductive material where heat may be dissipated from the lamp in part using the housing 105

The housing 105 and the Edison screw 103 define an internal cavity 107 for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The lamp electronics may be mounted on a printed circuit board which includes the power supply, including large capacitor and EMI components that are across the input AC line along with the driver circuitry as described herein. The base may be potted to protect and isolate the lamp electronics 110.

In some embodiments, a driver and/or power supply 110 are included in the base 102 as shown. Base 102 may include the power supply or driver and form all or a portion of the electrical path between the mains and the LEDs 127. The base 102 may also include only part of the power supply circuitry while some smaller components reside with the LED assembly 130. In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. Other embodiments are possible using different driver configurations or a boost supply at lower voltages.

In some embodiments the driver circuit may have an input configured to be coupled to a power source, such as a phase cut dimmer, that provides a varying voltage waveform. The driver may include electromagnetic interference suppression electronics to reduce noise in the driver. One such suitable electronics is shown and described in U.S. patent application Ser. No. 14/284,643, entitled "Lighting apparatus with Inductor Current Limiting for Noise reduction", filed on May 22, 2014, which is incorporated by reference herein in its entirety.

The term "electrical path" can be used to refer to the entire electrical path to the LED's 127, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LEDs. Electrical conductors run between the LEDs 127 and the lamp base 102 to carry both sides of the supply to provide critical current to the LEDs 127 as will be described.

The LED assembly 130 may be contained in an optically transmissive enclosure 112 through which light emitted by the LEDs 127 is transmitted to the exterior of the lamp. In the embodiments of FIGS. 1, 2, 3, 15, 16 and 18, for example, the enclosure 112 may be entirely optically transmissive where the entire enclosure 112 defines the exit surface through which light is emitted from the lamp. In the embodiment of FIG. 17 the enclosure 1112 of directional lamp 1100 may be partially optically transmissive where the enclosure comprises an optically transmissive exit surface 1116 and a reflector 1114 for reflecting light to the exit surface. The enclosure 112, 1112 may be made of glass, quartz, borosilicate, silicate, polycarbonate, other plastic or other suitable material. The enclosure may be of similar shape to that commonly used in standard BR and/or PAR incandescent bulbs (for example FIG. 17) or to A series bulbs (for example FIG. 1). In some embodiments, the exit surface of the enclosure may be coated on the inside with silica, providing a diffuse scattering layer that produces a more uniform far field pattern. The enclosure may also be etched, frosted or coated to provide the diffuser. In other embodiments the enclosure may be made of a material such as polycarbonate where the diffuser is created by the polycarbonate material. Alternatively, the surface treatment may be omitted and a clear enclosure may be provided. The enclosure may also be provided with a shatter proof or shatter resistant coating. It should also be noted that in this or any of the embodiments shown here, the optically transmissive enclosure or a portion of the optically transmissive enclosure could be coated or impregnated with phosphor or a diffuser.

Figure 30:
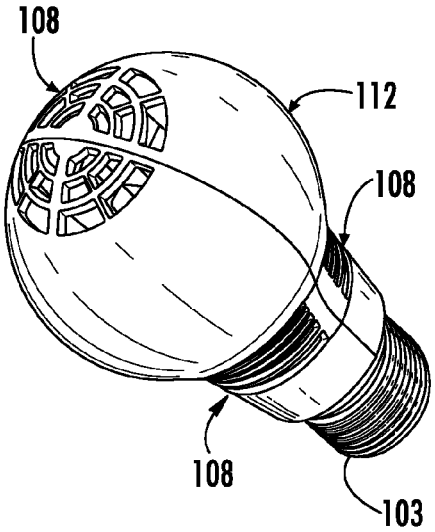
FIG. 30 is a perspective view of the lamp of FIG. 29.
Figure 29:
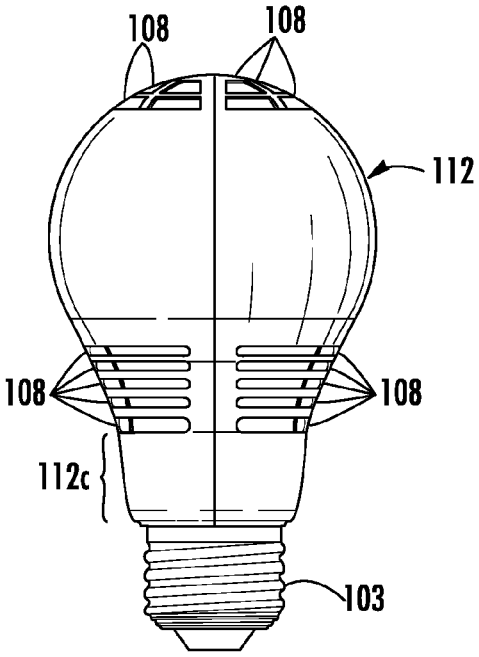
FIG. 29 is a plan view of another embodiment of the lamp of the invention.
Figure 31:
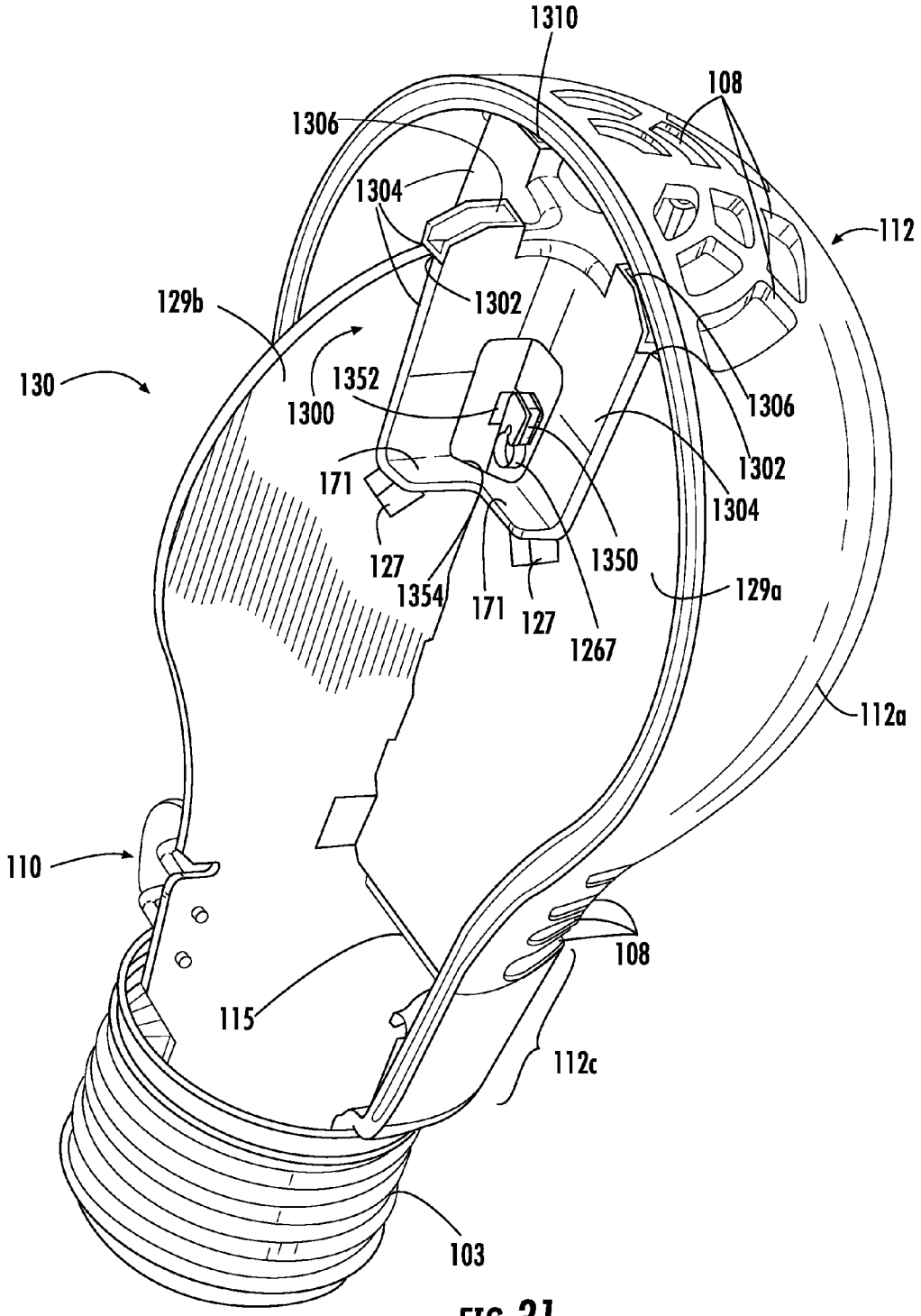
FIG. 31 is a perspective view of the lamp of FIG. 29 with a portion of the enclosure removed.
Figure 32:
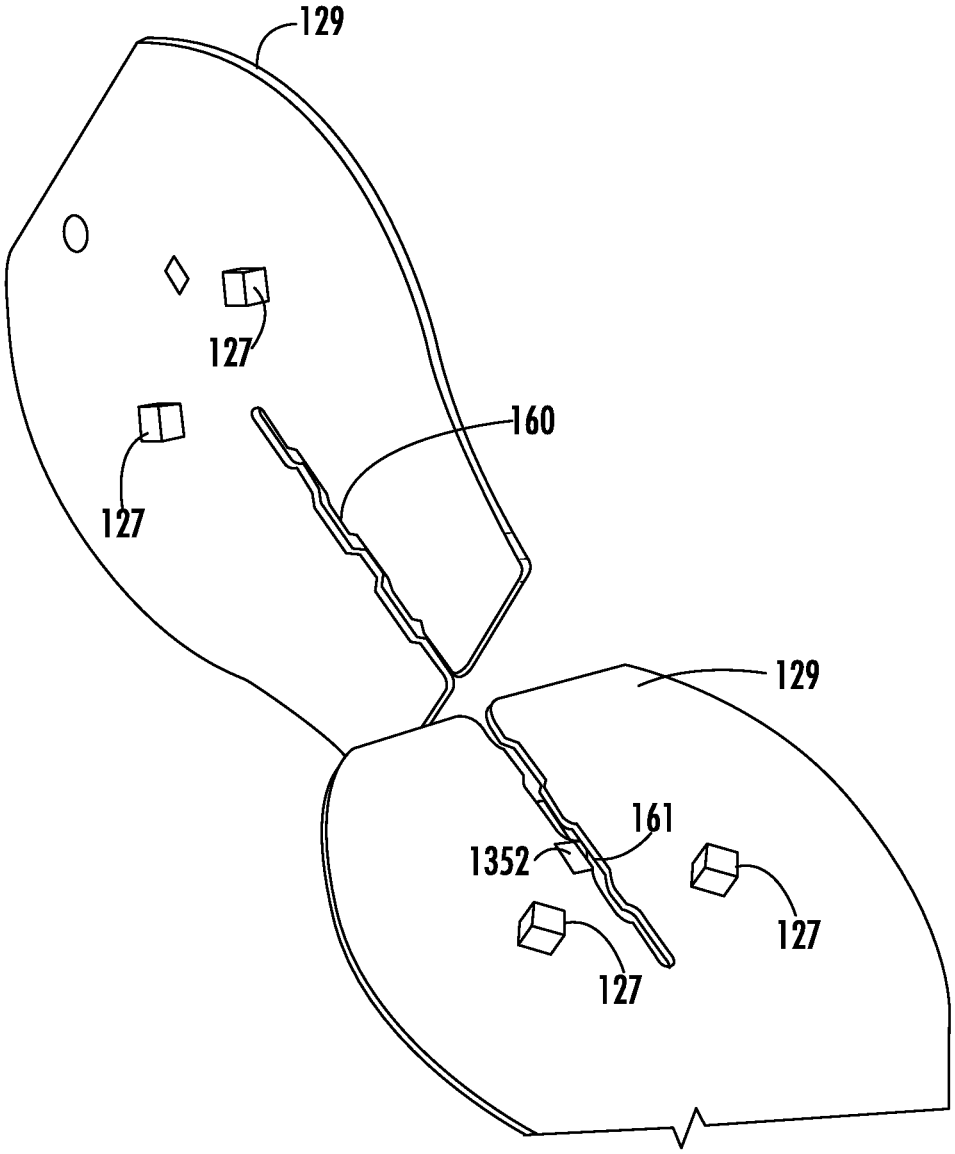
FIG. 32 is a perspective view of two LED boards illustrating the assembly of the LED assembly.

As shown in FIGS. 29-31, in one embodiment, in an A-series style lamp the enclosure 112 may be molded from a plastic material such as polycarbonate. The exterior surface of the enclosure may have a polished finish and in some embodiments may have a surface texture of VDI24 (VDI is a surface texturing scale from Verein Deutscher Ingenieure, the Society of German Engineers). While one specific surface texture index is provided, the surface may be manufactured to other standards provided a smooth exterior surface 112*a* of enclosure 112 is provided. Making the outer surface of the enclosure 112 with a polished finish creates a lamp that feels similar to a traditional glass bulb. Because the plastic enclosure may be molded, the interior surface 112*a* of the enclosure 112 may be provided with a rougher texture to provide mechanical diffusing of the light emitted from the lamp. In addition to the mechanical diffusion created by the textured interior surface 112*b* of the enclosure 112 the material or mixtures of the material of the enclosure may be selected to provide material diffusion. The amount of texturing on the inner surface of the enclosure and the material of the enclosure may be selected to vary the diffusive properties of the enclosure and create varying light patterns. The different surface texturing of the inner and outer surfaces of the enclosure may be provided in a single molding operation by varying the surface texture of the mold cavity as compared to the mold core.

In one embodiment the enclosure 112 extends to the Edison screw 103 such that the housing 105, as previously described, may be eliminated. By extending the enclosure 112 to the Edison screw 103 the lamp has the look and feel of a traditional incandescent bulb that typically has a glass bulb attached directly to an Edison screw. The lower portion 112*c* of the enclosure 112 houses the lamp electronics 110 as previously described. A divider wall 115 may extend from each half of the enclosure to create a partition that separates the lamp electronics 110 from the interior of the enclosure in which the LED assembly 130 is located. The divider walls 115 may be provided with an aperture or apertures to allow access to the lamp electronics 110 from the interior of the enclosure as will be described. In some embodiments, in order to hide the lamp electronics 110 from external view, the portion of the enclosure 112*c* that surrounds the lamp electronics may be provided with even greater surface texturing than the light transmissive portion of the enclosure 112 to prevent a person from viewing the lamp electronics.

Figure 2:
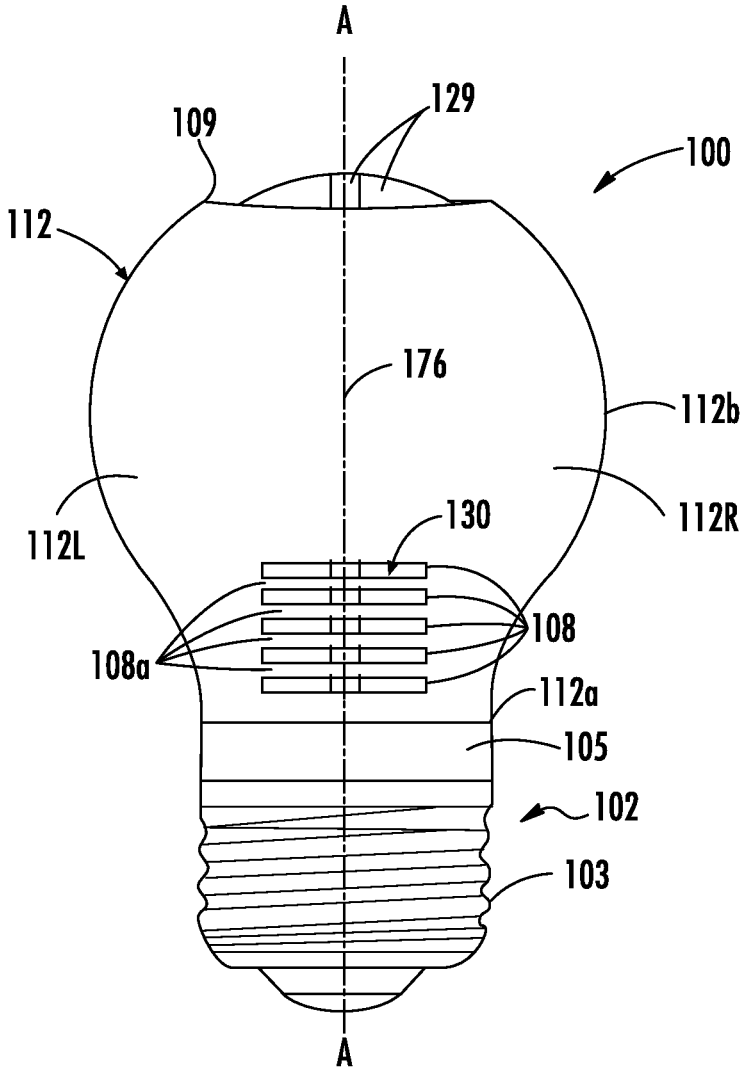
FIG. 2 is a plan view of another embodiment of a lamp of the invention.

In some embodiments the enclosure 112 may be provided with vent openings or apertures 108, 109 such that the interior of the lamp is in communication with the exterior of the lamp. The vent openings 108, 109 allow air to flow into, through and out of the enclosure 112 such that the air cools the LED assembly 130 inside of the enclosure. In one embodiment an aperture or apertures 108 are provided proximate to the base 102 and another aperture or apertures 109 are provided proximate to the distal end of the lamp such that air may flow through the enclosure 112 along the longitudinal axis of the lamp. The flow of air along the axis of the lamp creates a chimney effect that dissipates heat from the LED assembly 130. In the embodiment of FIG. 2 a plurality of apertures 108 are provided that are formed as relatively narrow elongated slots. In some applications it is desirable to prevent a direct line of sight from a person to the light source 127. Using relatively narrow elongated slots may be used to prevent a direct line of sight to the LEDs 127. It will be understood that the LEDs 127 may be positioned in the enclosure 112 and the apertures 108 may be configured such that as the angle of observation through the slots 108 changes the dividers 108*a* between the slots 108 block direct line of sight view of the LEDs 127. In other embodiments translucent blockers 171 (FIG. 17) may be formed as part of the enclosure and or LED boards or may be added as inserts inside of the enclosure where the blockers 171 are positioned to block direct line of sight to the LEDs through the apertures 108 and 109.

The LED assembly 130 may be implemented using a printed circuit board ("PCB") or other similar component which may be referred to as an LED board 129 and a plurality of LEDs 127. The lamp 100 is a solid-state lamp comprising a plurality of LEDs 127. Multiple LEDs 127 can be used together, forming an LED array 128. The LEDs 127 can be mounted on or fixed within the lamp in various ways. The LEDs 127 in the LED array 128 include LEDs which may comprise an LED die or a plurality of LED dies disposed in an encapsulant such as silicone, and LEDs which may be encapsulated with a phosphor to provide local wavelength conversion. A wide variety of LEDs and combinations of LEDs may be used in the LED assembly 130 as described herein. The LEDs 127 of the LED array 128 are operable to emit light when energized through the electrical path. The LED board 129 may comprise a series of anodes and cathodes arranged in pairs for connection to the LEDs 127. An LED 127 containing at least one LED or LED package is secured to each anode and cathode pair where the LED spans the anode and cathode. The LEDs may be attached to the LED board by soldering. While specific embodiments of LEDs are described herein, a greater or fewer number of anode/cathode pairs and LEDs may be used and the specific placement of the LEDs on LED boards 129 may vary from that shown.

LEDs 127 used with embodiments of the invention can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

Figure 6:
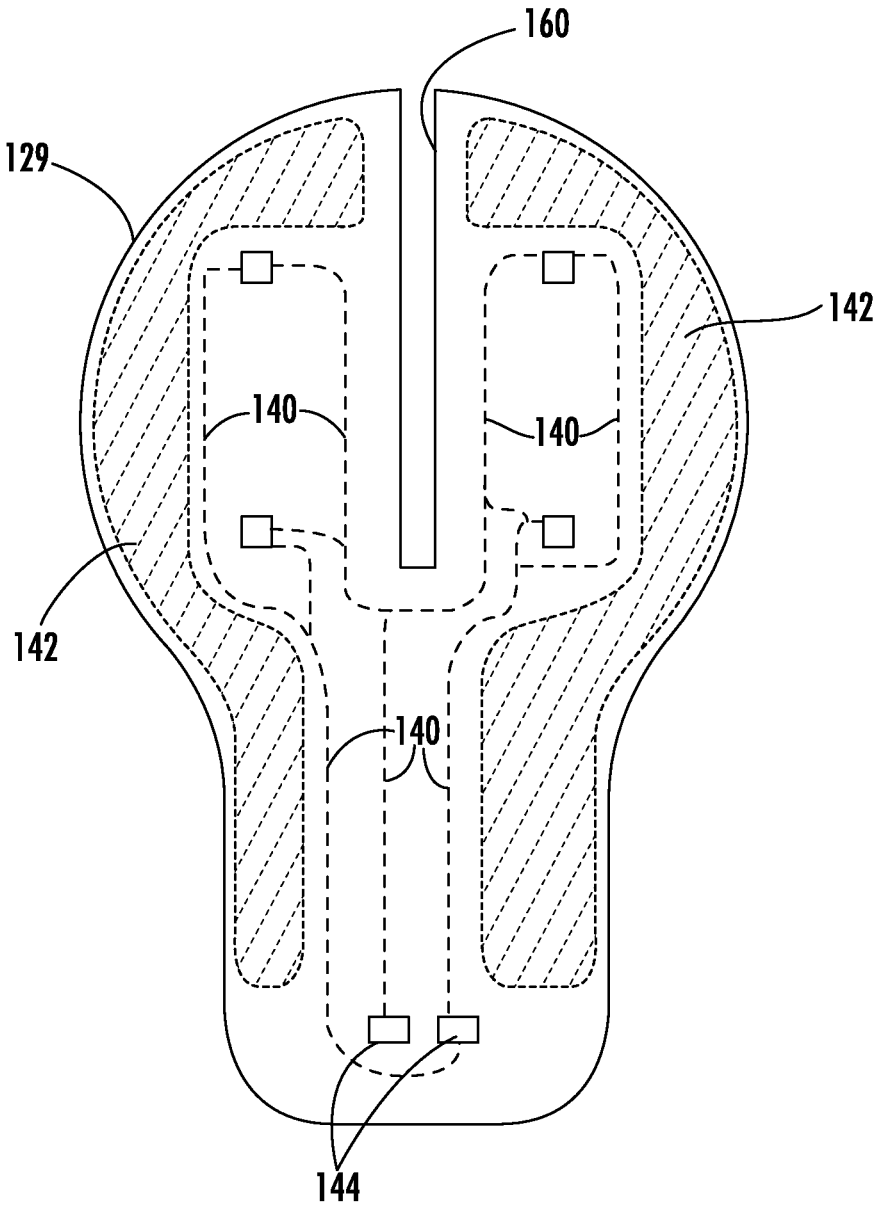
FIG. 6 is a plan view of a LED board usable in the lamp of the invention.
Figure 7:
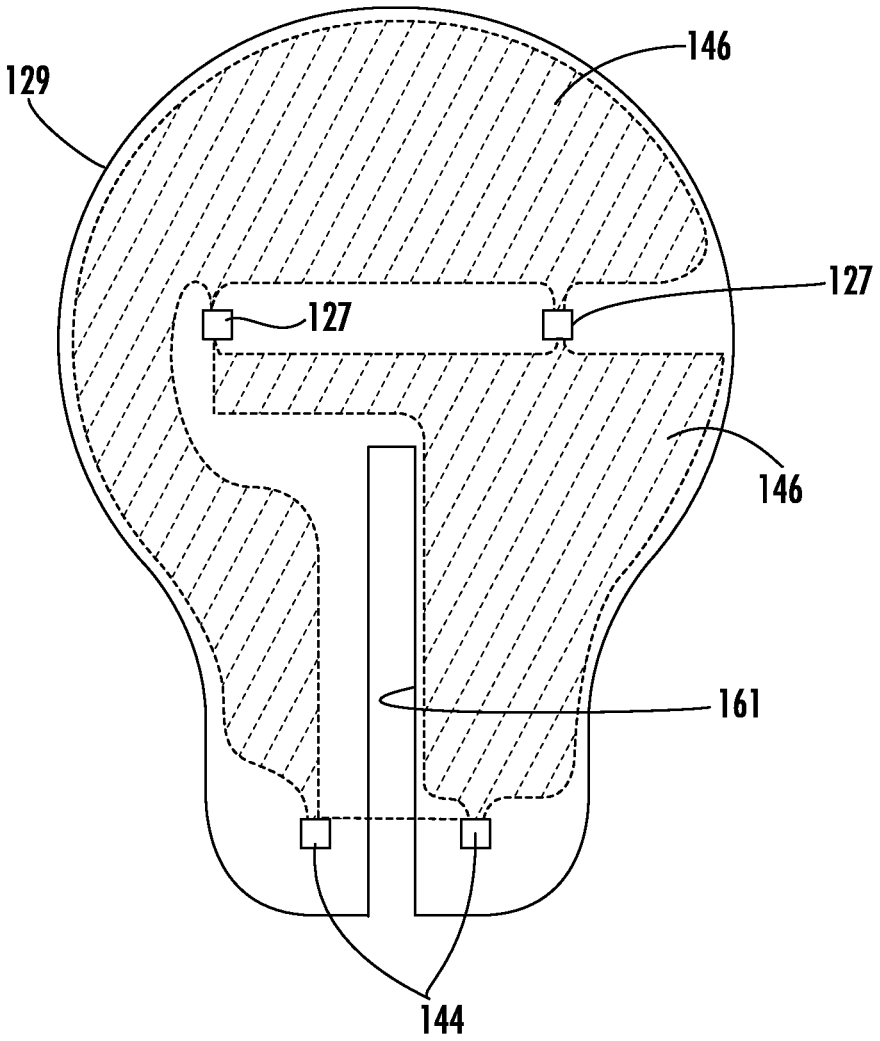
FIG. 7 is a plan view of another LED board usable in the lamp of the invention.

In some embodiments, the LED boards 129 may comprise a PCB, such as FR4 board, Chem3 board, a metal core printed circuit board (MCPCB), or other similar structure. The LED boards 129 comprise a thermally conductive material supported on a dielectric material or other electrically insulating material or materials. The thermally conductive area may be formed as part of the electrical path connecting the LEDs 127 to the electronics 110 in the base 102. In some embodiments a large area of the LED board 129 may be thermally conductive such that a large area of the entire LED assembly 130 acts as a heat dissipative element to transfer heat to the air in the enclosure 112. It will be appreciated that in a typical PCB the electrical connections may be formed as metal traces or conductors where the traces or conductors are made relatively small so as to cover as small of an area of the PCB as possible and still provide electrical connections to the components on the PCB. In the lamp of the invention the LED board 129 may be provided with thermally conductive material such as copper, aluminum or the like where the amount of metal or other thermally conductive material used is sufficient to conduct heat away from the LEDs 127 and dissipate the heat to the surrounding air during steady state operation of the lamp. The copper, aluminum, other metal or other thermally conductive material on the LED boards 129 may form part of the electrical path to the LEDs 127. In some embodiments the electrically and thermally conductive material may form relatively small traces as is commonly done with PCBs but additional thermally conductive material may cover a relatively large area of the LED board as a component separate from the electrically conductive traces that form the electrical path to the LEDs if the LEDs require additional thermal dissipation. If the LEDs require additional thermal dissipation, additional metal may be used in the LED board for the electrical connections to the LED assembly or additional heat sinking may be used. FIG. 6 shows an embodiment of a LED board 129 where the electrically conductive traces or conductors 140, that form the electrical path from lamp electronics 110 to the LEDs 127, are separate components from metal areas 142 (shaded areas) that do not form part of the electrical path and function to dissipate heat from the LEDs. In the actual device these areas may not be visible and may be covered by electrically insulating and light reflective material. The conductors 140 may terminate in pads 144 for connection to the lamp electronics 110. In the embodiment of the LED board 129 shown in FIG. 7, the conductors 146 that form the electrical path from the lamp electronics 110 to the LEDs 127 are formed as relatively large areas such that these areas function to provide current to the LEDs and to dissipate heat from the LEDs. In this embodiment the electrical conductors 146 are intentionally formed as larger areas than would ordinarily be the case if the conductors only functioned to provide current to the LEDs.

In some embodiments, the LED board 129 may comprise a PCB, such as FR4 board. In an FR4 PCB the FR4 provides a glass epoxy insulating substrate. A layer of conductive material such as copper may be laminated to one, or both sides of the FR4 substrate. The FR4 copper-clad sheets comprise circuitry etched into copper layers to produce printed circuit boards. FR4 printed circuit boards may be produced in multiple layers. In some embodiments, the LED board 129 may comprise a MCPCB that comprises a thermally and electrically conductive core made of aluminum or other similar pliable metal material. The core is covered by a dielectric material such as polyimide. Metal core boards allow traces to be formed therein. Other structurally rigid structures for the LED board 129 may also be used. In embodiments using a LED board such as FR4 or MCPCB, the LED board has structural rigidity such that the board physically supports the LEDs 127 in position in the lamp and forms part of the electrical path to the LEDs 127.

Figure 11:
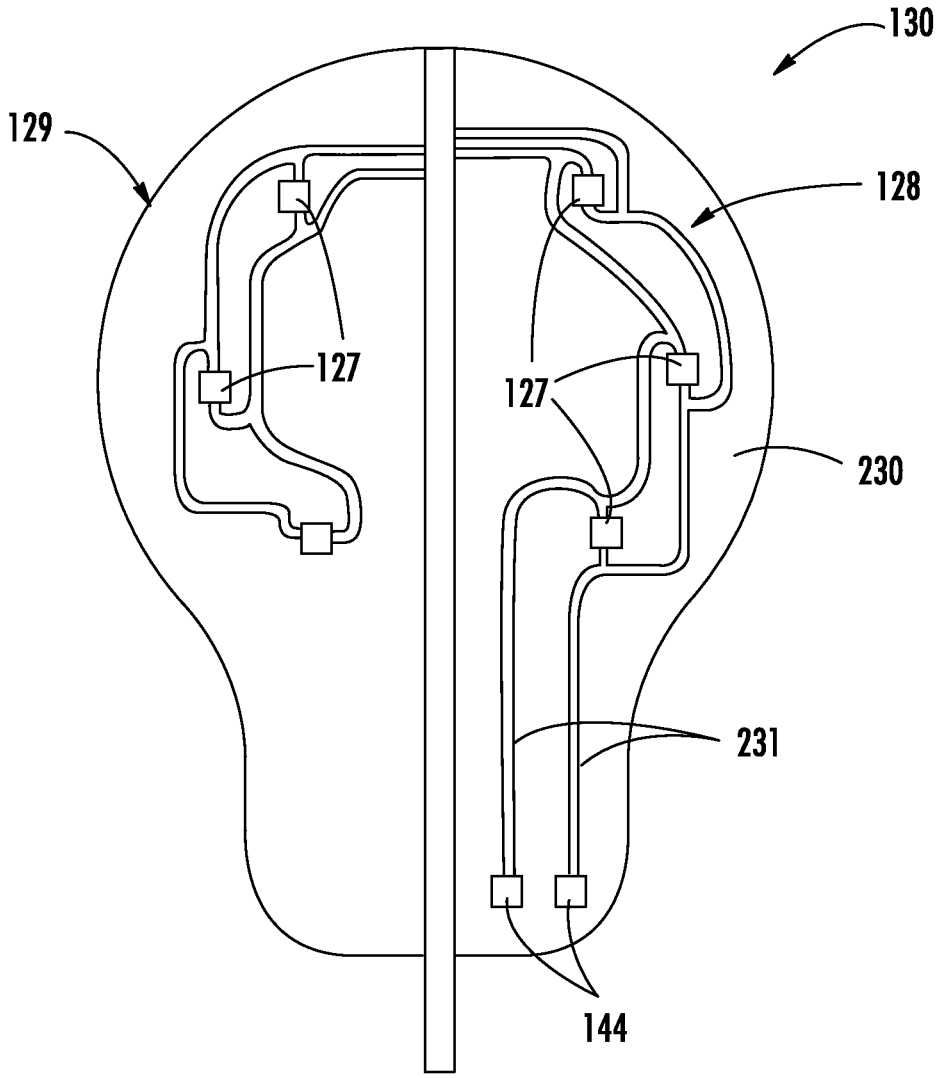
FIG. 11 is a plan view of another embodiment of an LED assembly usable in the lamp of the invention.
Figure 12:
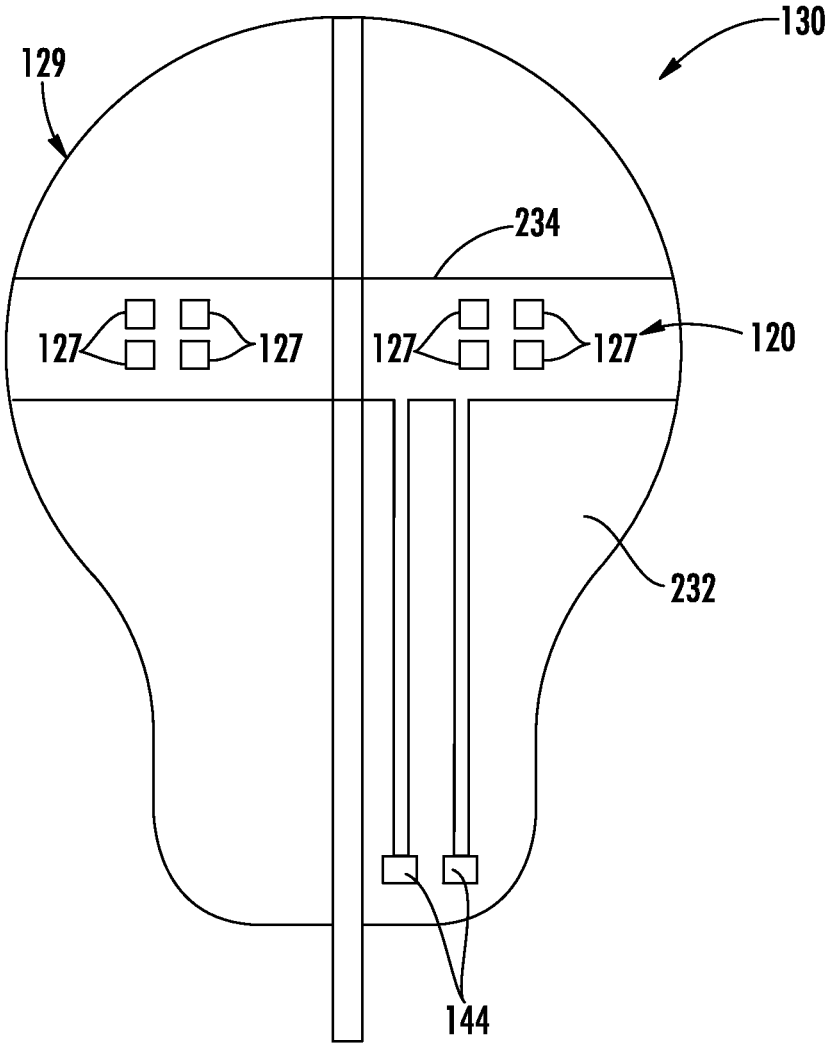
FIG. 12 is a plan view of yet another embodiment of an LED assembly usable in the lamp of the invention.

In some embodiments the LED board may comprise a hybrid structure where a rigid substrate physically supports the LEDs 127 in position in the lamp and where the electrical connections to the lamp may be made with a separate electrically conductive component. In some embodiments the electrical connections may be made using a flex circuit comprising a flexible layer of a dielectric material such as a plastic, polymeric, polyimide, polyester or other material to which a layer of copper or other electrically and thermally conductive material is applied such as by adhesive. Electrical traces are formed in the conductive layer of the electrically conductive material to form electrical pads for mounting the electrical components such as LEDs 127 and other lamp electronics 110 to the LED board and for creating the electrical path between the components. The conductive layer may be covered by a protective layer or layers. In other embodiments, a lead frame may be used to provide the electrical path to the LEDs 127 and may be made of an electrically conductive material such as copper, copper alloy, aluminum, steel, gold, silver, alloys of such metals, thermally conductive plastic or the like. Other electrical circuits may be used with the rigid substrate. The boards may be a single member or multiple members joined together. While in one embodiment the board may be a relatively thin planar member the board may have relatively wider or narrower portions.

Where the electrical connections are made using a device such as a flex circuit, lead frame, wires or the like that do not have sufficient structural rigidity to adequately support the LEDs in position in the lamp, the electrical circuitry may be mounted on a structurally rigid substrate. For example, referring to FIG. 11 the LED board 129 may comprise a substrate 230 made of a structurally rigid material, for example glass, having circuitry 231 applied to the surface of the substrate 230 such that the electrical connections to the LEDs 127 are provided by the circuitry 231. The circuitry 231 may comprise a lead frame or other conductive component that may be supported by substrate 230. In another embodiment, shown in FIG. 12, the LED board 129 comprises a substrate 232 such as metal, for example steel or aluminum, where a flex circuit 234 is mounted on the substrate 232 for providing the electrical path to the LEDs 127. The substrate may comprise a thermally transmissive material to dissipate heat from the LEDs 127. In these and in other embodiments, the metal layers of the circuitry may be made of a sufficient area to increase the heat dissipative properties of the lamp as previously described. Moreover, while specific combinations have been described the various components may be arranged in various combinations. For example, the flex circuit, lead frame or other electrical circuitry may be mounted on any of the substrates described herein or on any other suitable substrate. For example, the supporting substrate may comprise a PCB, graphene and/or plastic.

Figure 4:
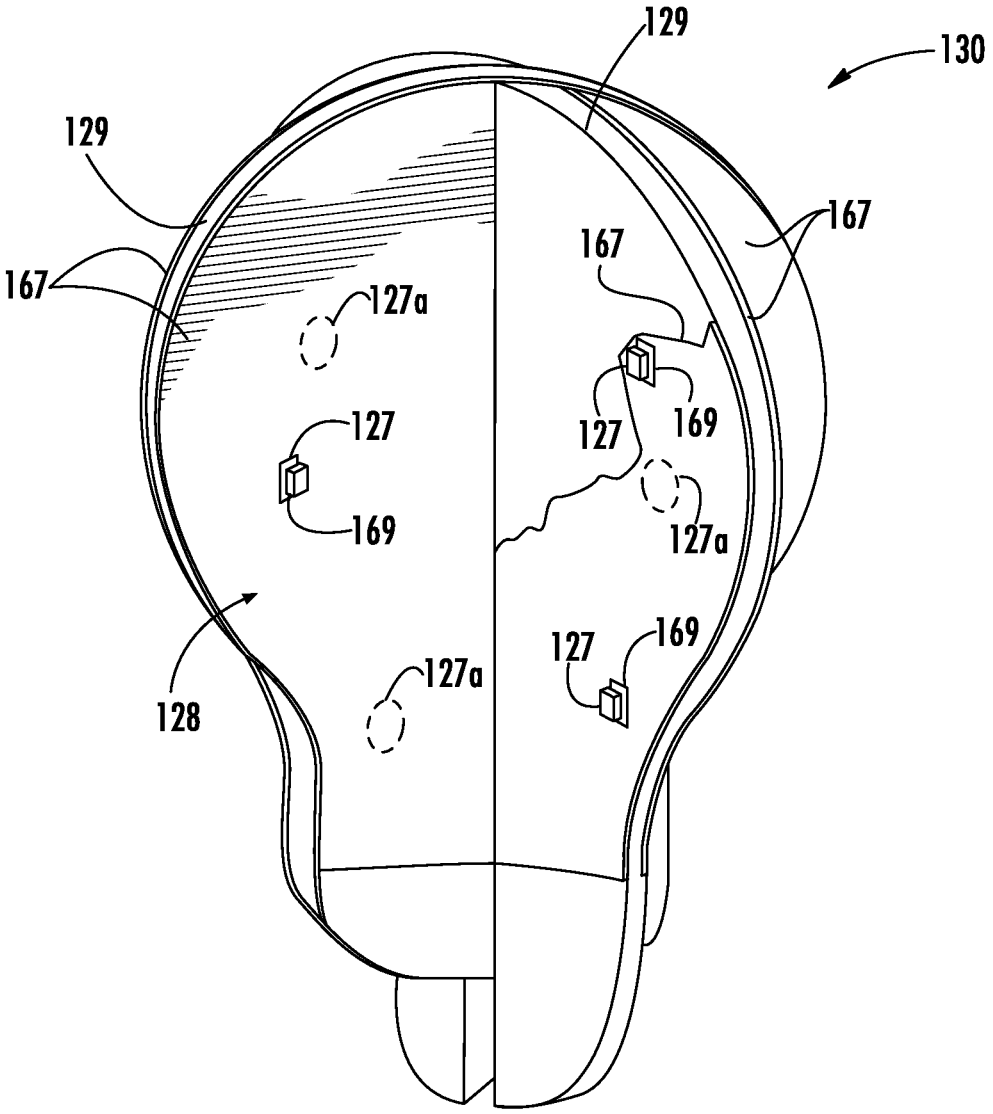
FIG. 4 is a perspective view of an embodiment of an LED assembly usable in the lamp of the invention.
Figure 5:
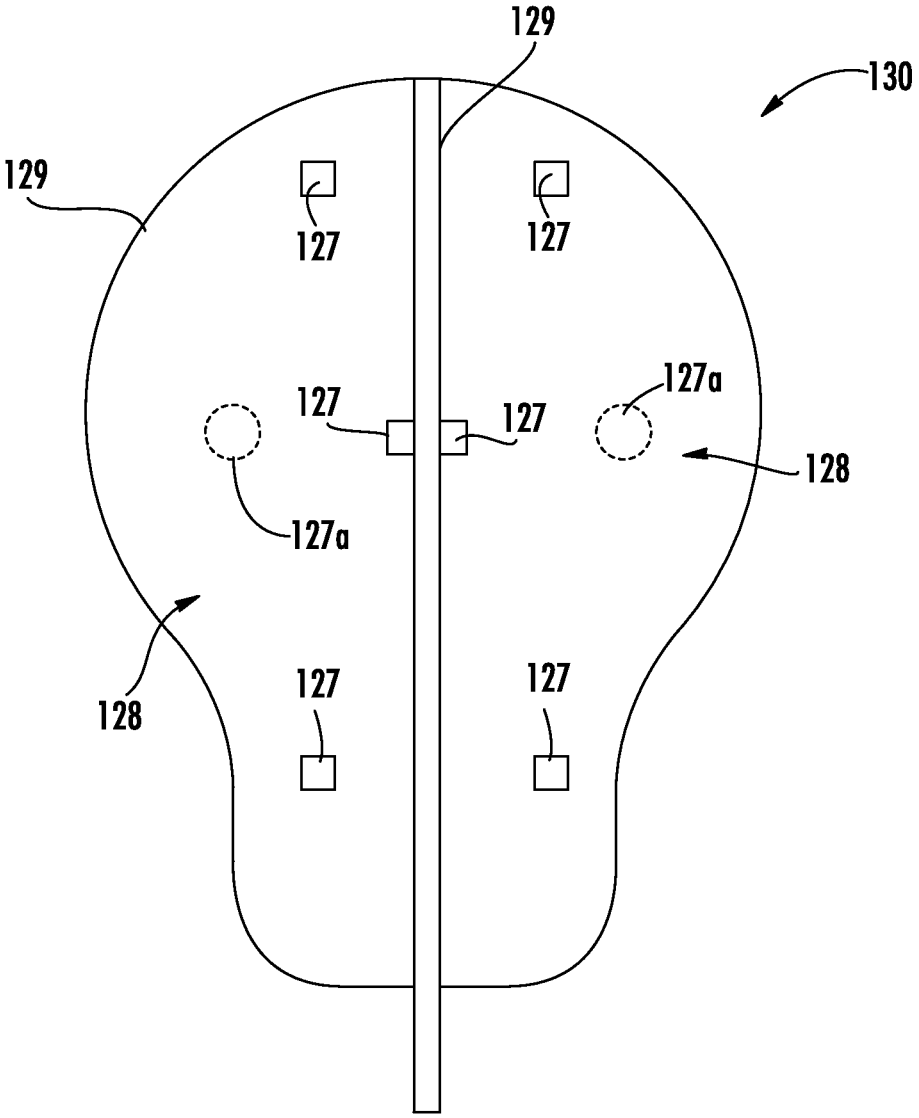
FIG. 5 is a plan view of the LED assembly of FIG. 4.

In one embodiment, the exposed surfaces of the LED assembly 130 may be made of or covered by a reflective surface, refractive optic surface, spreading surface and/or diffuse reflective surface 167, shown in FIG. 4, to reflect light inside of enclosure 112 during operation of the lamp. The surface 167 may be a diffuse reflector and may be made of a white highly reflective material such as injection molded plastic, white optics, PET, MCPET, or other reflective material. Using a diffuse reflector the reflected light is reflected at many angles where an ideal diffuse reflector has equal luminance in all directions. A diffuse reflector scatters light to provide a uniform distribution of light. In some embodiments the surface 167 may be a specular reflector material such as injection molded plastic or die cast metal (aluminum, zinc, magnesium) with a specular coating. A reflective coating may also be applied via vacuum metallization or sputtering, and could be aluminum or silver. Using a specular reflector the reflected light is effectively reflected as a mirror of the source. The reflective surface may also be a formed film, formed aluminum, or the like. The reflective surface may also include a transparent matrix loaded with a high index material such as a silicone with TiO2 particles. One such suitable reflective material is shown and described in US Patent Application Pub. No. 2012/0193647, entitled "Solid State Lighting Component Package with Reflective Layer" by Andrews, having a Pub. Date of Aug. 2, 20112, which is incorporated by reference herein in its entirety. The entire LED assembly 130, other than the LEDs 127, may be made of or covered in the reflective surface, refractive optic surface, spreading surface and/or diffuse reflective surface 167 or portions of the LED assembly 130 may be made of or covered in the reflective surface, refractive optic surface, spreading surface and/or diffuse reflective surface 167. For example, portions of the LED assembly 130 that reflect light may be made of or covered in reflective surface, refractive optic surface, spreading surface and/or diffuse reflective surface 167 while the remainder of the LED assembly 130 may comprise other materials including non-reflective materials. The reflective surface 167 may be applied to the LED boards 129 with "cutouts" 169 provided to expose the LEDs 127. In some embodiments the LED boards 129 may reflect a portion of the light and allow a portion of the light to pass through the LED board. For example, a glass substrate may allow some light to pass through the substrate and may reflect some of the light. As used herein a "reflective surface" means a surface that reflects at least a portion of the light from a light source whether the reflection is diffuse, Specular, spread or combinations of such reflections and includes surfaces that have refractive optical properties in addition to reflective properties.

Referring to FIGS. 4-9, for example, in one embodiment the LED assembly 130 may comprise a plurality of LED boards 129 arranged to create a desired light pattern. The LED boards 129 are arranged to divide the area inside of the enclosure 112 into three-dimensional sectors or quadrants where the LED boards 129 form the walls of the sector and a portion of the enclosure 112 between the walls of the sector encloses the sector. In other embodiments the LED boards may extend a shorter distance such that the LED boards 129 do not extend all of the way to the enclosure 112 where the sectors are defined by the LED boards but the sectors are not physically enclosed by the enclosure such as shown for example in FIG. 16. In such an embodiment the sectors are open to the interior of the enclosure such that light may communicate between the sectors internally of the enclosure 112. The boards may comprise a variety of different shapes and sizes. For example, the boards may be configured to match the shape of the interior of the enclosure where the bottom of the board is narrower than the top of the board, the boards may be a simple rectangular, circular or other geometric or random shape that is unrelated to the shape of the enclosure.

Figure 8:
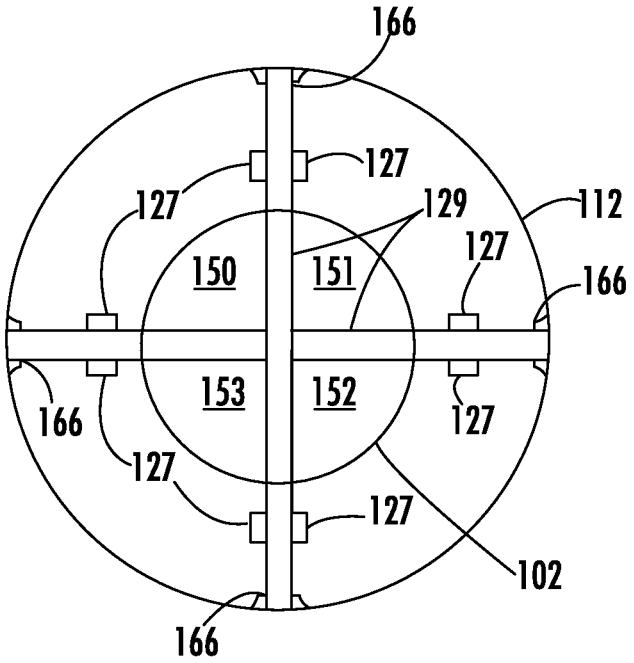
FIG. 8 is a top view of the lamp of FIG. 1 showing an embodiment of the LED assembly.
Figure 9:
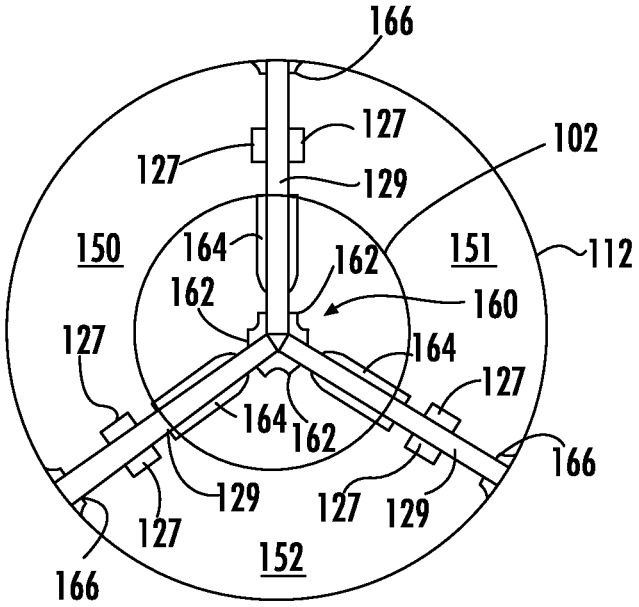
FIG. 9 is a top view of an embodiment of the lamp of the invention showing an embodiment of the LED assembly.

In the embodiment of FIGS. 4-8 four sectors or quadrants 150-153 are provided and in the embodiment of FIG. 9 three sectors 150-152 are provided. In FIGS. 8 and 9 the enclosure 112 are shown as clear to show the internal structure of the lamp. Each sector defines a three-dimensional space that is approximately one-fourth of the volume of the enclosure 112. The LEDs 127 are mounted on the LED boards 129 such that at least one and typically a plurality of LEDs 127 are provided in each sector. Each LED 127 in a sector may emit some of the light directly out of enclosure 112 while some of the emitted light is reflected off of the reflective surface of the LED boards that define that sector. The light reflected from the reflective surfaces of the LED boards creates a reflected light source 127*a*. Thus, in each sector the LEDs 127 produce an actual light source from LEDs 127 and a reflected light source 127*a* from the light reflected off of the opposing LED boards. The light from the actual light sources 127 and the reflected light from the reflected light sources 127*a* combine and are mixed to create a uniform light that is emitted from the lamp in a desired pattern. By creating a reflected light source 127*a* a single physical light source 127 may be used to create two apparent light sources such that the emitted light source is expanded. The area directly across from the light source 127 reflects the most light from the light source 127 such that this area is considered a reflected light source 127*a*; however, because the typical LED emits light in a wide pattern the entire area of the LED board may reflect at least some light as the light is reflected between the opposing walls of the sector. The light sources 127 may be arranged in a variety of patterns on the LED boards. In some embodiments the LEDs may be grouped closely together to create a concentrated light source. The LEDs 127 may be arranged such that the LEDs are substantially in the center of the enclosure 112. As used herein the terms "center of the enclosure" refers to the vertical position of the LEDs in the enclosure as being aligned with the approximate largest diameter area of the globe shaped main body 114. "Vertical" as used herein means along the longitudinal axis of the bulb where the longitudinal axis extends from the base to the free end of the bulb as represented for example by line A-A in FIG. 2. In one embodiment, the LEDs are arranged in the approximate location that the visible glowing filament is disposed in a standard incandescent bulb. The term "center of the enclosure" does not necessarily mean the exact center of the enclosure and are used to signify that the LEDs are located along the longitudinal axis of the lamp at a position between the ends of the enclosure near a central portion of the enclosure. The LED boards 129 are positioned such that the plane of the LED boards that comprise the reflective surfaces extend radially from the longitudinal axis of the lamp such that the reflective surfaces are disposed generally parallel to the longitudinal axis of the lamp. Other patterns for the light sources 127 and reflected light sources 127*a* are possible in addition to those shown and described herein. For example all light sources 127 may be provided on one LED board and all reflected light sources 127*a* on another LED board rather than providing light sources 127 and reflected light sources 127*a* on each of the LED boards.

Figure 3:
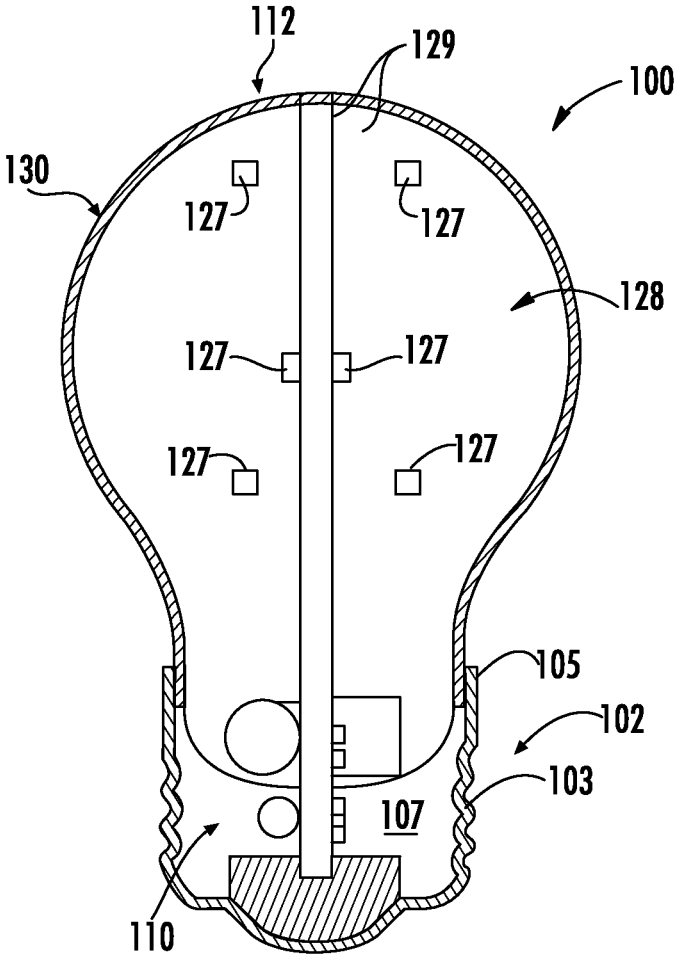
FIG. 3 is a section view of the lamp of FIG. 1.

In one embodiment the space inside of the enclosure 112 is divided into four sectors or quadrants 150-153 where each quadrant comprises at least one actual light source 127 and includes reflective surfaces to reflect the light from the actual light source as reflected light sources 127*a*. In the illustrated embodiment three LEDs 127 are provided in each sector with one LED on one of the sector walls and two LEDs on the opposite sector wall where the LEDs are arranged such that they are not directly across from one another. The LED boards 129 may be shaped and dimensioned such that they extend close to or abut the interior surface of the enclosure 112 as shown in FIG. 3. In this manner light generated by the LED sources in each sector is transmitted out of the enclosure 112 from that sector. In other embodiments, as shown for example in FIG. 16, the LED boards 129 may not follow the shape of the enclosure 112 such that the edges of the LED boards 129 may be spaced from the interior surface of the enclosure 112 to create a gap G between the edge of the LED boards 129 and the enclosure 112 such that at least a portion of the light originated in one sector may be transmitted into other sectors before being emitted from the enclosure 112. In such an embodiment the LED boards may have a wide variety of shapes and configurations. In some embodiments where the LED boards are used to dissipate heat from the LEDs using relatively large LED boards may be advantageous. In other embodiments where the LEDs do not produce as much heat or where the heat produced does not adversely affect the LEDs such as, for example, in low power applications, the LED boards may be made very narrow such that the LED boards extend as a column or tower along the longitudinal axis of the lamp but do not extend toward or near the enclosure 112. Using relatively narrow LED boards may limit the heat dissipation by the LED boards, but the narrow LED boards do not block light emitted from the LEDs and do not create shadows or dark spots on the enclosure.

In one embodiment the four quadrants are formed by two LED boards 129 where the LED boards are arranged to section the internal space of the enclosure 112 into four substantially equal quadrants 150-153. In one embodiment each LED board 129 comprises a rigid substrate and a metal layer that provides the electrical path to the LEDs 127 and that functions to dissipate heat as previously described. As previously explained, the LED boards 129 may be provided with a metal layer beyond what is required to make the electrical connections to the LEDs 127 in order to increase the heat dissipating properties of the LED boards. The metal layer may be covered by a dielectric or insulating material on both sides and the dielectric or insulating material may comprise reflective material or it may be covered in a reflective material. Each LED board 129 may also be comprised of more than one PCB board arranged back to back to create the LED boards 129. The LEDs 127 may be soldered to conductive pads formed by the conductive layer in desired positions on the LED boards 129.

In one embodiment two LED boards 129 may be used where the boards intersect to form the four quadrants. As shown in FIGS. 4-8 each LED board 129 may have a size and a shape such that the periphery of the LED boards 129 are closely adjacent to or abut the interior surface of the enclosure 112 in the completed lamp. The LED boards 129 may include central slots 160, 161 configured such that the slots may be engaged to allow the LED boards 129 to intersect one another to create a three-dimensional LED assembly 130 and to fit into the interior space of the enclosure 112. As shown, two LED boards 129 may be used to form a lamp with the four quadrants 150-153. FIG. 9 shows an embodiment of a lamp having three LED boards 129 where each board extends from approximately the center line of the lamp to the enclosure 112 to define three sectors 150, 151 and 152. In such an embodiment each LED board 129 may be formed with a shape that corresponds to the shape of approximately one-half of the enclosure 112 such that in the completed lamp the LED boards cooperate to define plural sectors where each sector is bounded by two LED boards 129 and the portion of the enclosure 112 that spans the two LED boards. In some embodiments the slots 160, 161 may be formed with a serpentine shape such that the width of the slot (and the corresponding bit size that cuts the slots) does not necessarily conform to the width of the LED boards. The serpentine shape of the slot may be used to create a snug engagement between the LED boards.

Figure 33:
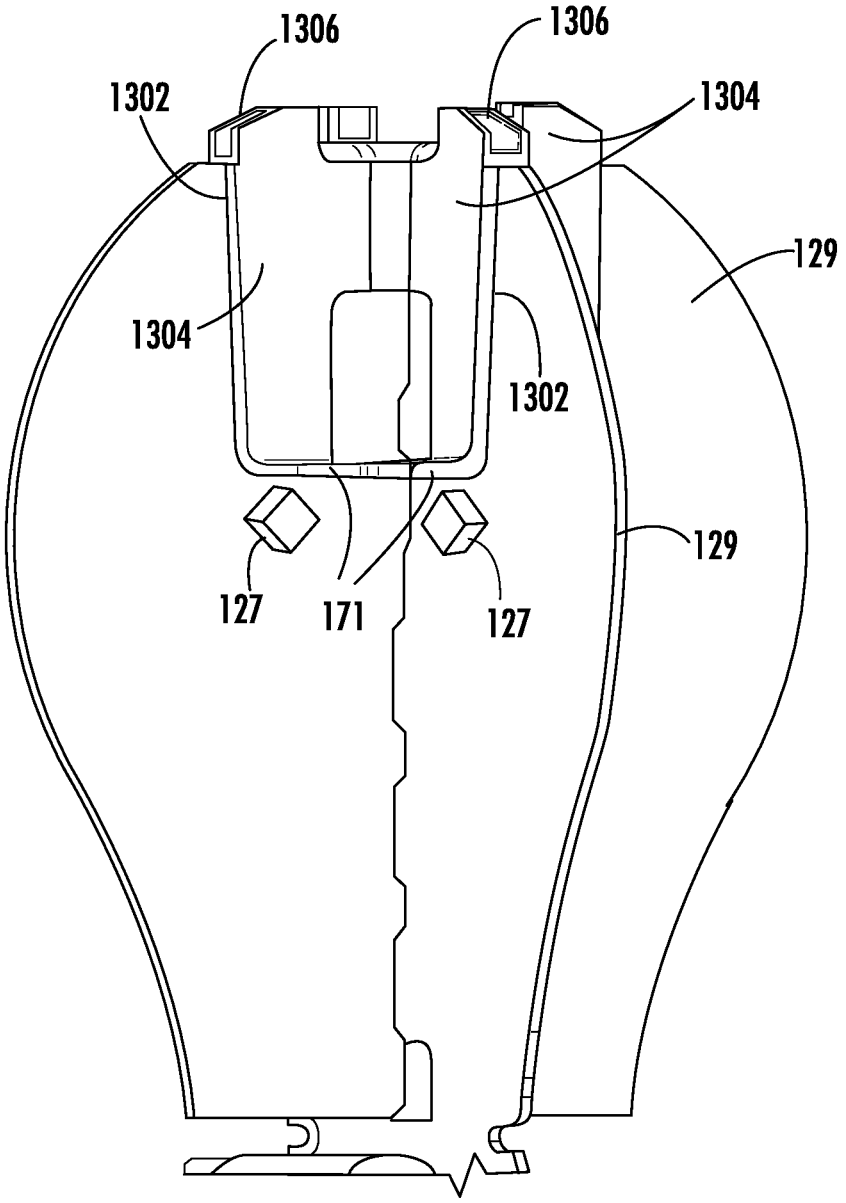
FIG. 33 is a perspective view of the LED assembly of FIG. 29.
Figure 34:
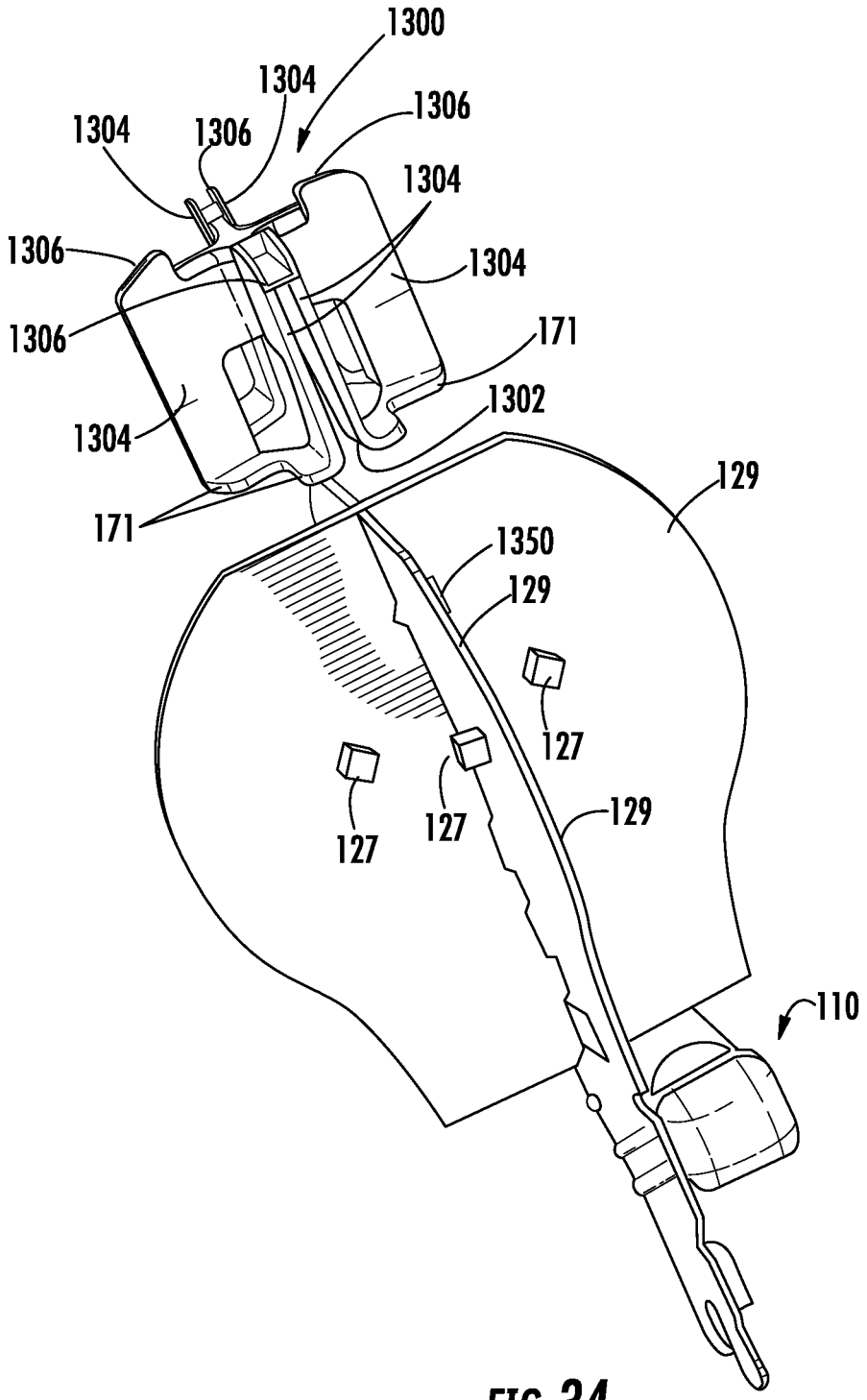
FIG. 34 is an exploded view of the LED assembly of FIG. 33.
Figure 35:
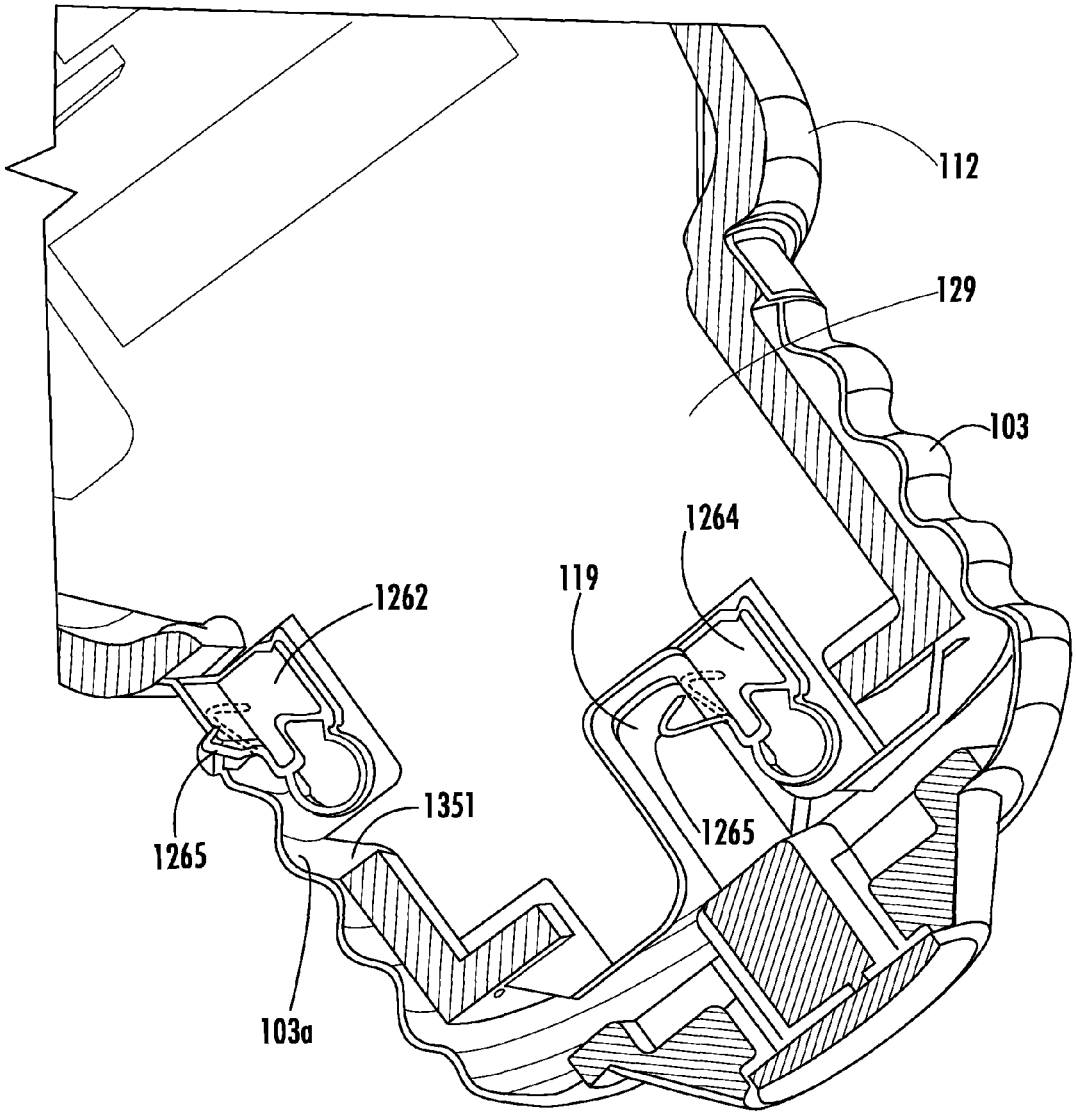
FIGS. 35 and 36 are partial perspective section views of embodiments of the base connections usable in the lamps of the invention.
Figure 36:
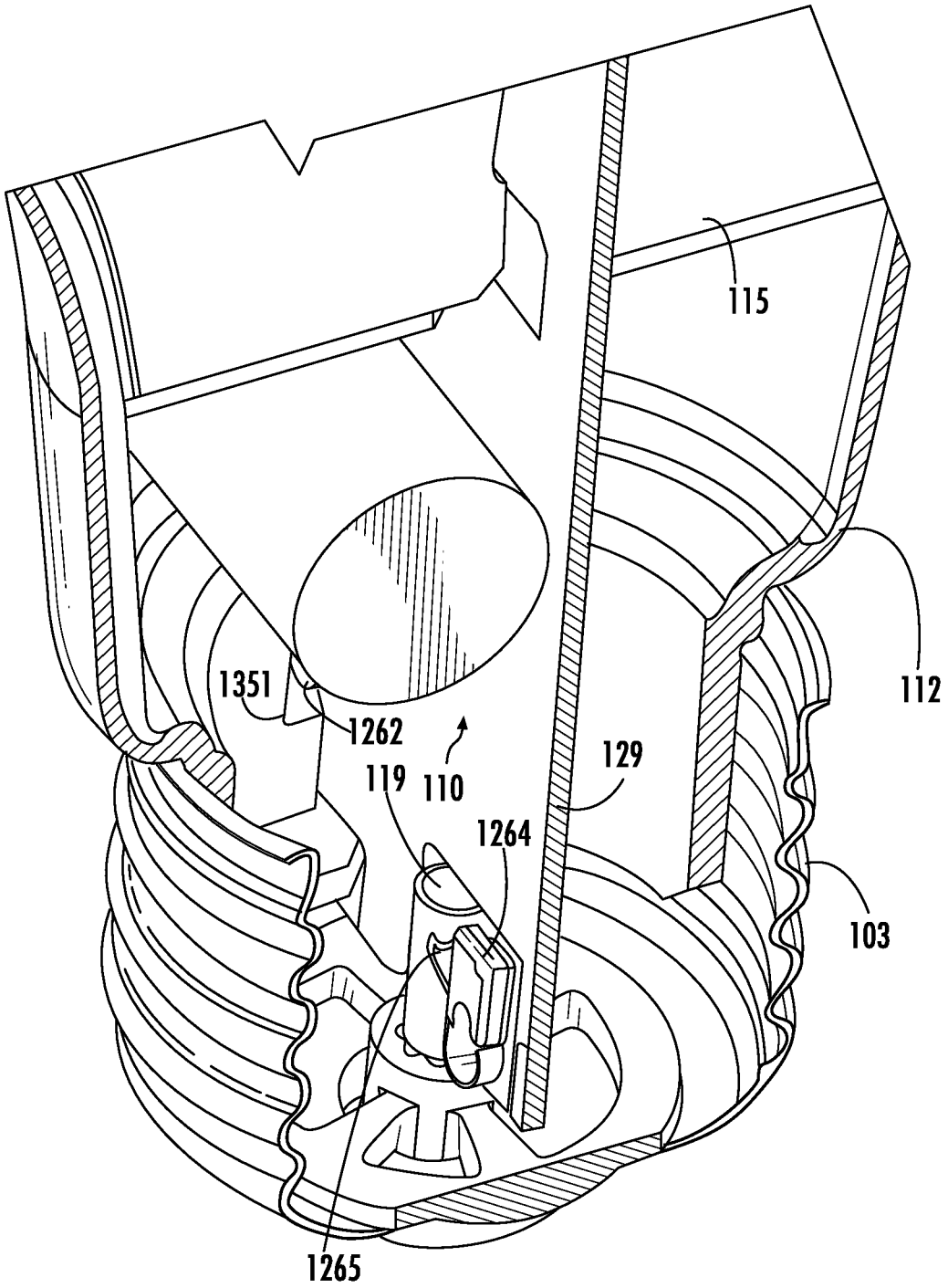

In one embodiment the LED boards may be connected to one another using a reinforcement member 1300 that also may be used to prevent line of sight to the LEDs and to change the emitted light pattern as shown in FIGS. 33 and 34. The reinforcement member 1300 may comprise a molded plastic member. The reinforcement member 1300 engages the top edges of the LED boards 129 to hold the boards in position relative to one another. The reinforcement member 1300 may include a plurality of channels 1302 defined by side walls 1304 arranged to receive the top edges of the LED boards 129. The side walls 1304 extend substantially parallel to the LED boards such that the LED boards may be inserted into the reinforcement member in a linear direction. In the illustrated embodiment the two LED boards define four quadrants such that the reinforcement member includes four channels 1302 one channel arranged to receive one of the four panels. Where the LED assembly includes other than four panels the reinforcement member 1300 comprises the same number of channels. The reinforcement member is slid over the top edges of the LED boards 129 such that the top edges of the LED boards are fixed in position relative to one another.

The reinforcement member 1300 may also include the LED blockers 171 as previously described. The LED blockers 171 may comprise members that extend from the side walls and are disposed over the LEDs 127 such that direct line of sight to the LEDs through vent openings 108 is blocked. In one embodiment the blockers 171 comprise substantially planar members that extend from the lower edge of the side walls 1304; however, the blockers may be located elsewhere on the reinforcement member and may have other shapes and sizes than that shown. Because light emitted from the LEDs 127 will strike the blockers the blockers may be made of different materials and may have different sizes, shapes and orientations to modify the pattern of light emitted from the lamp. In some embodiments the reinforcement member may be made of diffusive material such as plastic such that the blockers may diffuse and reflect the light in varying amounts. The blockers 171 may be made of a reflective material to reflect the light rather than diffuse the light. Further while the blockers 171 are shown as planar members arranged substantially perpendicular to the LED boards the blockers 171 may be curved or faceted and may be arranged at varying angles relative to the LED boards 129. In some embodiments the side walls 1304 may be made of one material and the blockers 171 made of a second different material.

The reinforcement member may also be formed with an engagement structure that interlocks with a mating engagement structure on the enclosure 112. In one embodiment the reinforcement member 1300 is formed with a plurality of channels or slots 1306 arranged near the top edge of the reinforcement member. The enclosure 112 is formed with mating projections 1310 that engage the channels 1306 when the LED assembly is positioned in the enclosure 112. The engagement of the projections 1310 with the channels 1306 fixes the position of the LED boards 129 relative to the enclosure such that the LED boards do not rattle inside of the enclosure. While the male projections are described as being formed on the enclosure 112 and the female channels are formed on the reinforcement member 1300 these components may be reversed such that male members are formed on the reinforcement member and the female members are formed on the enclosure.

The individual LED boards 129 may be connected to one another at their inner edges generally along the longitudinal axis of the lamp to hold the LED assembly 130 together during assembly of the lamp. The LED boards 129 may be adhered to one another using an adhesive or epoxy. The boards may also be secured to one another using fasteners. A support structure such as a column 160 may also be used in addition to or in place of the adhesive or fasteners to secure the LED boards 129 together. More than one column may be used. The column 160 may have channels 162, clips or other integrated mechanical structure for engaging the edges of the LED boards. The LED boards 129 may also mechanically engage one another without using a separate column. For example, some of the LED boards may include protrusions along the inner edge that engage female slots or apertures formed along the interior edge of other ones of the LED boards. Other mechanisms for joining the LED boards to one another may also be used and the various mechanisms may be used in combinations with one another. While a lamp having four sectors or quadrants is shown in FIG. 8 and a lamp having three sectors is shown in FIG. 9, the LED assembly 130 may have a greater or fewer number of sectors where each sector comprises at least one actual light source or LED 127.

In some embodiments the LED boards 129 may be supported by the base 102 at their lower edges such that the LED boards may not be connected to one another. For example, the base 102 may include receptacles such as channels 164 (FIG. 9) that engage the lower ends of the LED boards 129 such that the boards are connected to and supported by the base 102 but may or may not be connect to one another. In other embodiments, the LED boards 129 may engage support structures in the enclosure rather than in the base or in addition to other support structures. For example the enclosure may include internal channels 166 that receive the outer edges of the LED boards 129. The various connection mechanisms may be used in various combinations.

Because in some embodiments the LED boards 129 are dimensioned to be closely received by the enclosure 112 and because the enclosure 112 may have a form factor with a relatively narrow neck 112*a* that widens to a globe 112*b* it may not be possible to insert the LED assembly 130 into the enclosure 112 through the neck 112*a*. In some embodiments the enclosure may be formed of two parts such as an upper part 112U and a lower part 1125 that connect at a seam 175 roughly the equator of the enclosure 112 (FIG. 1) or a left part 112L and a right part 112R that connect along a longitudinal seam 176 (FIG. 2). The LED assembly 130 may be located in a first part of the enclosure and the second part of the enclosure may be attached to the first part to trap the LED assembly in the enclosure 112. The enclosure parts may be secured together by any suitable connection mechanism such as adhesive, mechanical fasteners, welding or the like.

Figure 10:
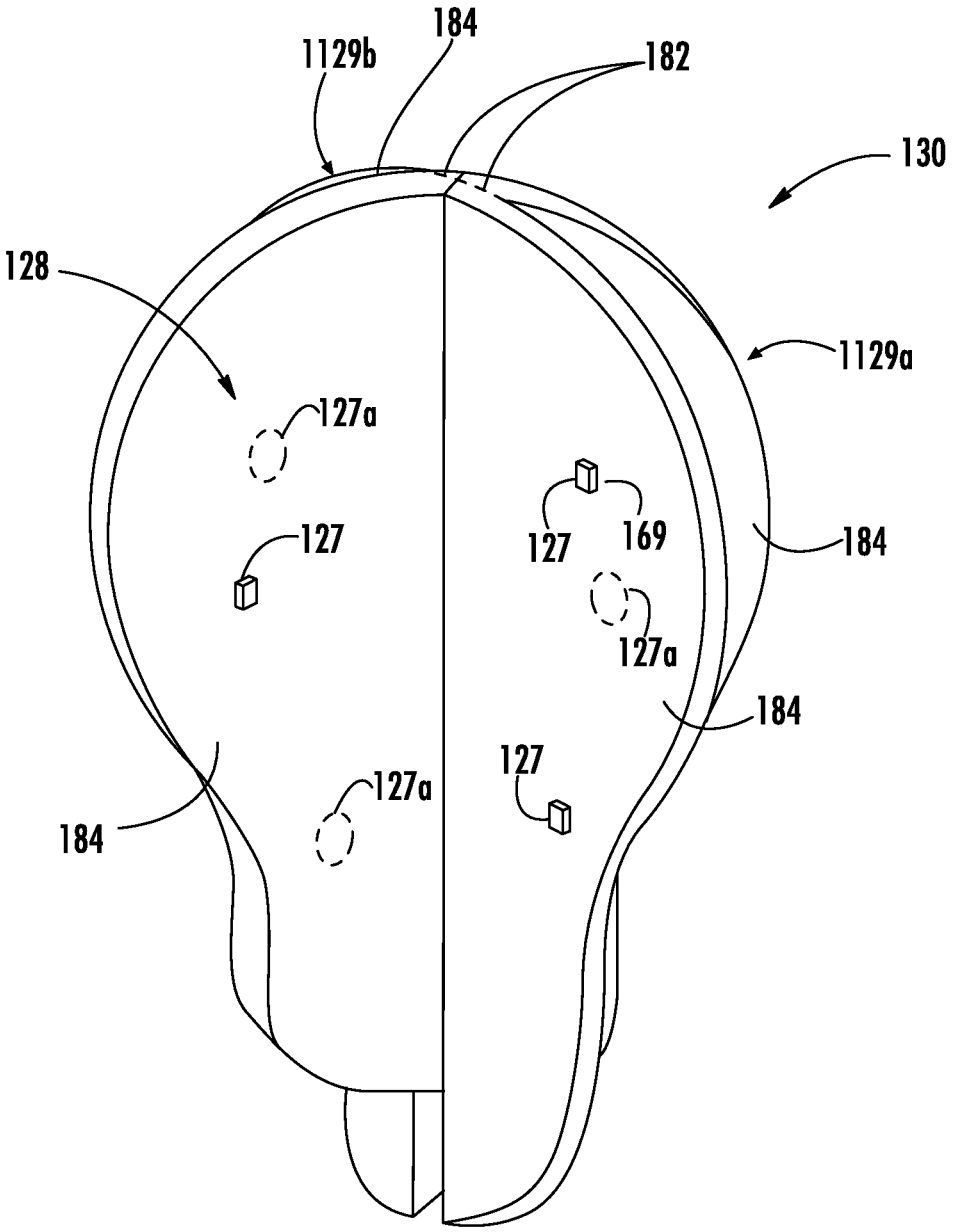
FIG. 10 is a perspective view of an alternate embodiment of a LED assembly usable in the lamp of the invention.

In some of the embodiments described above, the LED boards 129 comprise planar members formed of a relatively rigid material. In other embodiments the LED boards may be formed of a bendable component such as MCPCB as shown in FIG. 10. Using a bendable component the LEDs 127 may be mounted on the component and the component may be bent to fit into the enclosure 112. One or more bendable LED boards may be used that have mounting surfaces for the LEDs that are in more than one plane. A MCPCB comprises a thermally and electrically conductive core made of aluminum or other similar pliable metal material. The core is covered by a dielectric material such as polyimide. Metal core boards allow traces to be formed therein. In one method, the MCPCB is formed as a flat member and the LEDs 127 are mounted on the MCPCB in the flat condition. The MCPCB is then bent into a suitable shape. Because the MCPCB is made of thin bendable material and the anodes and cathodes may be positioned in a wide variety of locations, and the number of LED packages may vary, the MCPCB may be configured such that it may be bent into a wide variety of shapes and configurations. The LEDs 127 may be located on the flat sections such that the MCPCB may be bent along the score lines 181 to form the flat sections 180 into a three-dimensional shape where the shape is selected to project a desired light pattern from the lamp 100. One embodiment of a bendable LED board is shown in FIG. 10 where two LED boards 1129*a* and 1129*b* are used each having an approximately 90 degree bend formed down a center score lines 182 thereof such that the flat sections 184 of each LED board 1129*a*, 1129*b* form two walls. The LED boards may be connected at the interior bend lines 182 by any suitable connection and/or may be supported by the base or enclosure as previously described.

In one embodiment the LEDs 127 may be formed on the facing walls of each sector in complementary positions. As was previously explained, each LED 127 creates an actual light source that emits light. The light from each LED 127 may also be reflected from the facing wall to create a reflected light source 127*a*. Because the reflected light is used to create a reflected light source 127*a*, the LEDs 127 on the facing walls may be offset from one another such that the area of the wall opposite to the LEDs 127 is a reflective surface. In this manner a relatively fewer number of LEDs 127 may be used where a single LED is used to create the actual light source and the reflected light source.

While the LEDs may be arranged offset from one another, in some embodiments, as shown in FIGS. 31-34, the LEDs may be arranged in the same relative location on the LED boards 129 such that the LEDs are disposed directly opposite to one another. In one embodiment the lamp is provided with eight total LEDs with one LED mounted on each facing LED board in the same relative location such that the LEDs are aligned with one another in the vertical and horizontal directions. In one embodiment eight XPG LEDs manufactured and sold by CREE INC. may be used. While the LEDs are located directly across from one another the facing LED boards still reflect a significant portion of the light emitted from the opposed LED.

Figure 14:
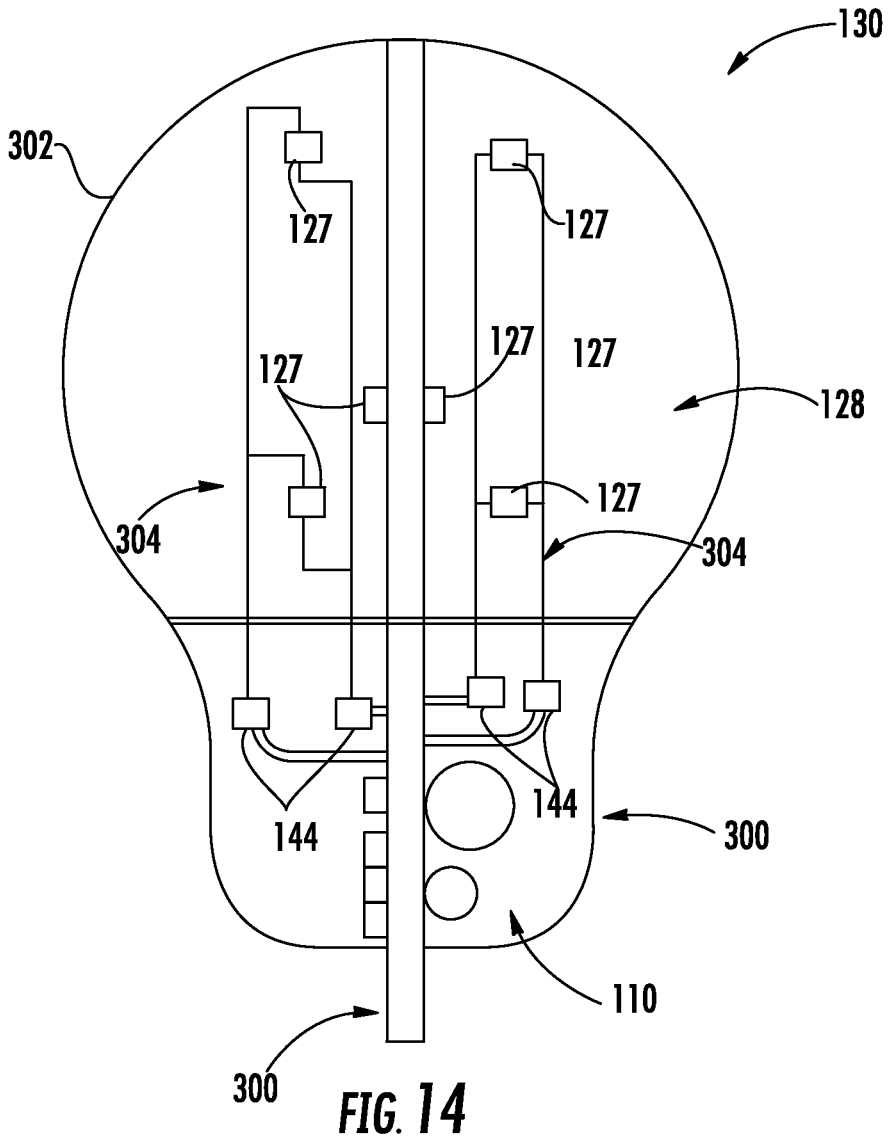
FIG. 14 is a plan view of still another embodiment of an LED assembly usable in the lamp of the invention.

Because the LEDs 127 may be mounted on the electrically conductive LED boards 129 one or more of the LED boards 129 may be used to mount the lamp electronics 110 in the base 102. Specifically, one or both of the LED boards 129 may be shaped to extend into the base 102. The lamp electronics 110 may be mounted directly on the end of the LED board, as shown in FIG. 3, such that a separate PCB board is not required for the lamp electronics. Traces or other circuitry may be provided on the LED boards 129 to connect the lamp electronics to the LEDs 127 on the boards. While a separate PCB is not required, the lamp electronics may be mounted on a separate lamp electronics PCB and the lamps electronics PCB may be connected the circuitry on the LED boards 129 by separate electrical conductors. Referring to FIG. 14 in one embodiment, a PCB 300 such as a PCB FR4 board may be used to form a bottom portion of the LED assembly 130. The lamp electronics 110 may be mounted on the PCB 300 to provide an electrical path from the electronics 110 to the LEDs 127. In some embodiments the LED board may also comprise a substrate 304 such as metal, plastic, glass or the like that form the upper portion of the LED board 129 and that supports the LEDs 127. Electrical conductors 304 runs from the PCB 300 to the LEDs 127 such as by, for example, a lead frame, flex circuit or the like to complete the electrical path to the LEDs 127. In this manner the portion of the LED assembly 130 in the enclosure 112 may be provided with different optical and/or thermal characteristics than the PCB board that supports the lamp electronics 110.

To provide electrical current from the lamp base 102 to the lamp electronics 110 on the LED boards 129 a soldered, wired connection may be used between the conductive base such as Edison screw 103 and the LED boards 129. In some embodiments spring contacts may be used such that the electrical connection between the Edison screw 103 and the lamp electronics may be made without soldering or wires by inserting the LED board 129 into the Edison screw 103. The LED board 129 comprises a first spring contact 1262 that is electrically coupled to one of the anode or cathode side of the lamp electronics 110 and a second spring contact 1264 for connecting to the other one of the anode or cathode side of the lamp electronics. The first spring contact 1262 and the second spring contact 1264 are arranged such that the contacts 1262, 1264 extend from the LED board 129. The spring contacts 1262, 1264 are configured such that they create an electrical connection to the anode side and the cathode side of the Edison screw 103. Where an Edison screw 103 is used one spring contact creates a contact coupling with the inside wall 103*a* of the screw 103 and the other spring contact creates a contact coupling with the centerline contact 119. The contacts 1262, 1264 comprise resilient conductors 1265 such that the conductors 1265 are deformed when the LED board 129 is inserted into the screw 103 to ensure a good electrical contact with the base. The engagement between the spring contacts 1262, 1264 the contacts of the Edison screw 103 is a contact coupling where the electrical coupling is created by the contact under pressure between the contacts 1262, 1264 and the Edison screw 103 as distinguished from a soldered coupling and does not require separate wires or soldering.

To mount the LED assembly to the Edison screw 103, the LED board 129, with the spring contacts 1262, 1264 is inserted into the base 102 such that the spring contacts are positioned in the Edison screw 103. The resilient conductors 1265 of spring contacts 1262, 1264 are deformed as the LED board is inserted into the screw 103. Specifically, as the LED board is inserted into the screw 103 the resilient conductor 1265 of first spring contact 1262 is deformed (from the solid line position to the dashed line position) by and creates an electrical contact coupling with the interior surface 103*a* of the wall of the screw 103. An aperture 1351 may be provided in the enclosure 112 to allow the spring contact 1262 to access the Edison screw 113. The LED board is inserted until the resilient conductor 1265 of the second spring contact 1264 contacts and is deformed (from the solid line position to the dashed line position) by the centerline contact 119 of the screw 103. The physical contact between contact 1262 and wall 103*a* and the physical contact between contact 1264 and centerline contact 119 creates electrical contact couplings. The bias force created by the deformation of the resilient conductors 1265 with the screw 103 ensures a good electrical connection between the LED boards 129 and the screw 103 without requiring soldering or wires. Because the centerline contact 119 is disposed along the axis of the screw 103 and the wall 103*a* of the screw 103 surrounds the LED board, the LED board may be inserted into the base 102 in any angular orientation provided that the LED board is generally centered in the base. However, if desired guides may be formed in the base 102 to properly orient the LED board relative to the base.

While the electrical interconnect has been described with reference to an Edison base, the base electrical interconnect as described herein may be used with any style of base, such as, but not limited to, single contact bayonet connectors, double contact bayonet connectors, pin connectors, wedge connectors or the like, where the spring contacts 1262, 1264 are configured to contact the electrical contacts of the base. It will be appreciated that the spring contacts and/or PCB may be configured to conform to the shape, size and configuration of the base. Moreover, a greater or fewer number of contacts may be provided \depending upon the configuration of the lamp electronics and/or the base contacts.

In some embodiments the LED boards may be electrically coupled to the lamp electronics 110 independently of one another. However, in some embodiments the lamp electronics 110 may be coupled to one LED board and that LED board may be electrically coupled to the other LED boards. For example a soldered connection may be made between the electronics on the LED boards. In one embodiment a spring contact may be used to provide the electrical connection between the LED boards. As shown in FIG. 31 one LED board 129*a* may be provided with a spring contact 1350 that is electrically coupled to the electronics on that LED board. The other LED board 129*b* may be provided with an electrical contact such as a pad 1352 that is coupled to the electronics on that LED board. The pad 1352 is located and configured to make contact with the resilient conductor 1267 of the spring contact 1350 when the LED boards 129*a*, 129*b* are assembled. The contact of the pad 1352 with the resilient conductor 1267 of the spring contact 1350 deforms the conductor to create a bias such that the conductor 1267 exerts a force on the pad 1352 to maintain a good electrical coupling therebetween. This type of electrical connection is referred to herein as a contact coupling as distinguished from a soldered coupling and does not require soldering or wires. In order to accommodate the spring contact 1350, the blockers 171 may be configured to leave a gap 1354 between the blockers 171 and the LED boards to allow the reinforcement member 1300 to be slid onto the LED boards without interference with the electrical contacts.

Figure 18:
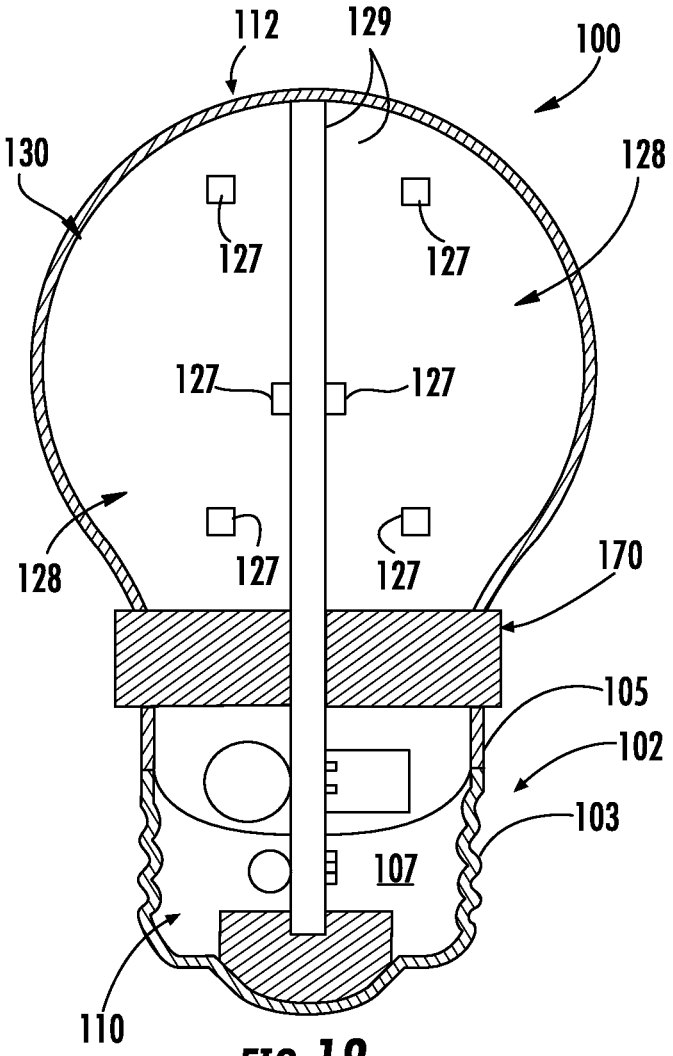
FIG. 18 is a section view of another embodiment of the lamp of the invention.

Because the LED boards 129 are provided with a relatively large area of thermally conductive metal such as copper or aluminum the LED boards can dissipate heat from the LEDs without requiring a separate heat sink structure. However, a separate heat sink structure 170 may be used in addition to the LED boards 129. For example, FIG. 18 shows a lamp with a separate heat sink structure 170 that is exposed to the ambient environment. The heat sink 170 may be made of a thermally conductive material such as aluminum and may include a heat dissipating structure such as fins. The LED boards 129 may be thermally coupled to the heat sink 170. For example, the LED boards 129 may be in direct physical contact with the heat sink structure 170. Alternatively a separate thermally conductive member may thermally couple the LED boards 129 to the exposed heat sink 170. While a separate heat sink 170 may be used, in one preferred embodiment the cost and complexity associated with a separate heat sink may be eliminated by using the LED boards without a heat sink to dissipate heat from the LEDs as previously described.

Figure 15:
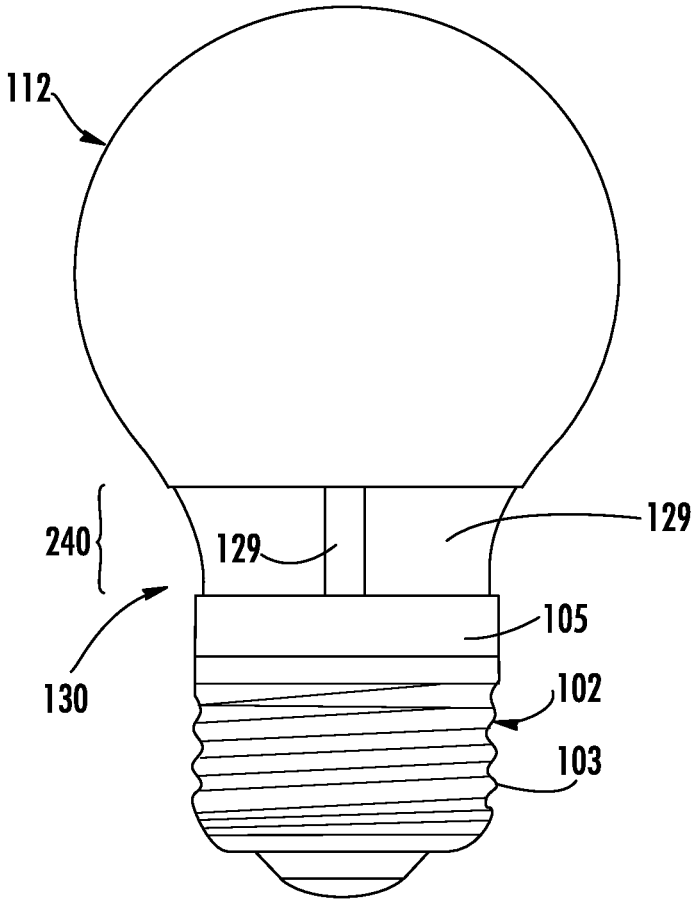
FIG. 15 is a plan view of another embodiment of a lamp of the invention.
Figure 16:
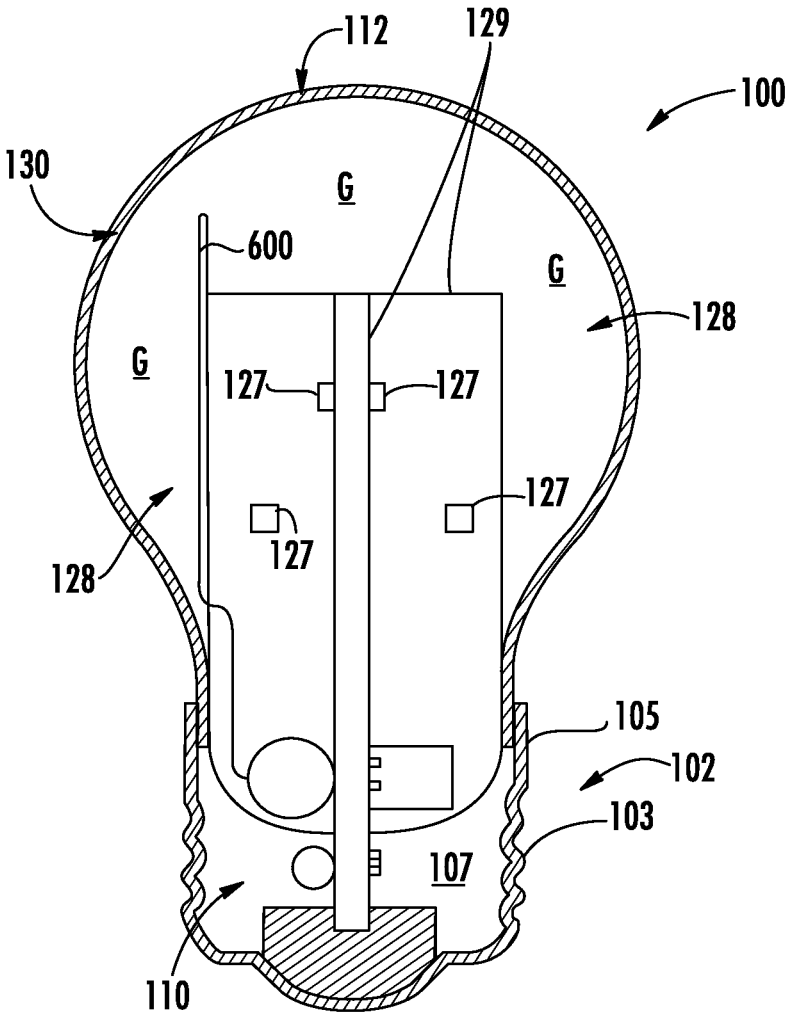
FIG. 16 is a section view of another embodiment of the lamp of the invention.

While in the embodiments of FIGS. 1-12 the LED assembly 130 is shown entirely contained in the enclosure 112 (except for apertures 108, 109), the LED boards 129, between the enclosure 112 and the base 102, may be located external of the enclosure 112 as shown in FIG. 15. In this arrangement the exposed areas 240 of the LED boards 129 comprise an external heat dissipating area. The enclosure 112 encloses the LEDs to provide a light mixing and diffuser chamber for the emitted light by the enclosure does not enclose the entire LED assembly 130. Further, in the embodiment illustrated in FIGS. 1 and 2 the apertures 108, 109 may be eliminated if sufficient heat may be dissipated from the LEDs 127 to the air or other gas in the enclosure 112 and from the enclosure 112 to the ambient environment to create acceptable thermal control for the LEDs.

Figure 13:
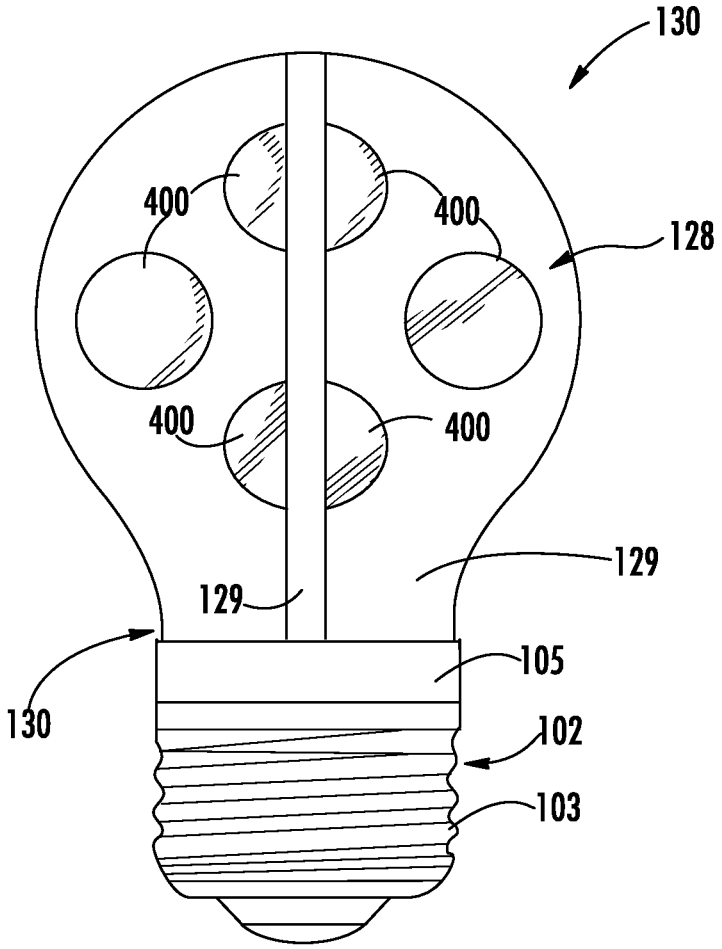
FIG. 13 is a plan view of another embodiment of a lamp of the invention.

Referring to FIG. 13, in other embodiments of the lamp, the enclosure 112 may be eliminated and a separate diffuser element or lens 400 may be provided with each LED or group of LEDs 127. The lens 400 may be mounted to the LED boards 129 over the LEDs 127 such that light emitted from the LEDs 1127 is mixed and/or otherwise treated by the lens. The lens 400 may be made of glass, quartz, borosilicate, silicate, polycarbonate, other plastic or other suitable material. In some embodiments, the exit surface of the lens 400 may be coated on the inside with silica, providing a diffuse scattering layer that produces a more uniform far field pattern. The lens 400 may also be etched, frosted or coated to provide the diffuser. In other embodiments the lens 400 may be made of a material such as polycarbonate where the diffuser is created by the polycarbonate material. Alternatively, the surface treatment may be omitted and a clear lens be provided. The enclosure may also be provided with a shatter proof or shatter resistant coating. It should also be noted that in this or any of the embodiments shown here, the lens 400 may be coated or impregnated with phosphor or a diffuser.

Figure 19:
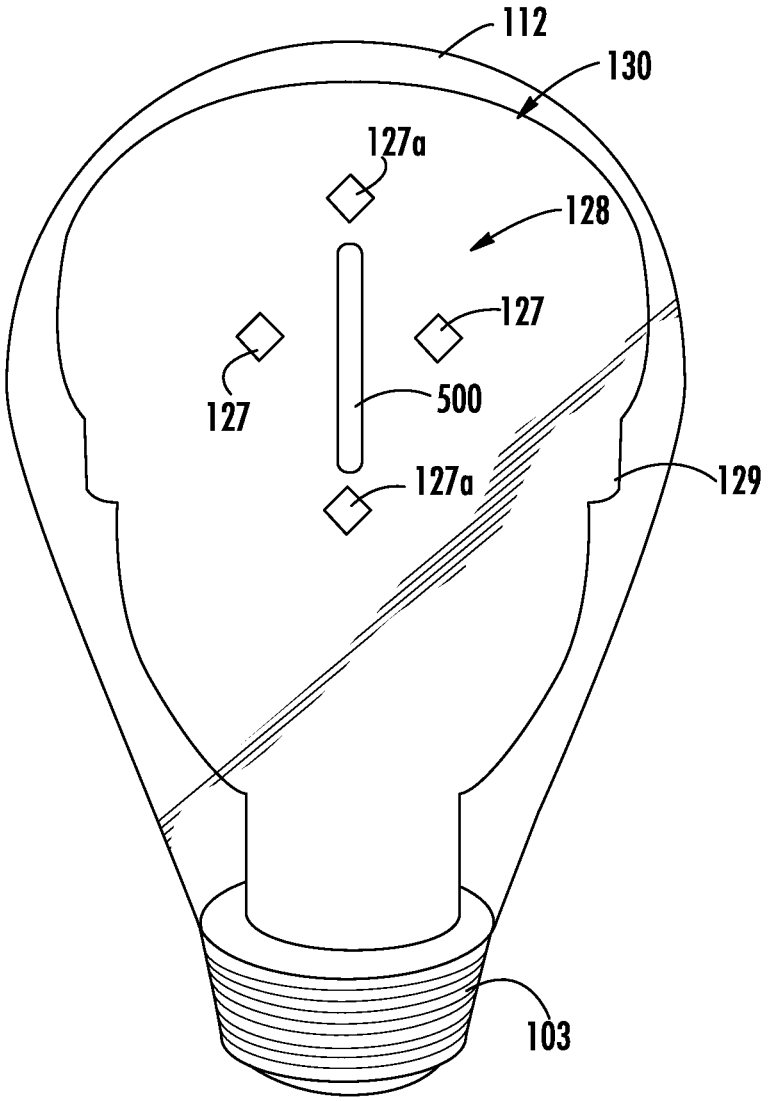
FIGS. 19 and 20 are schematic views of alternate embodiments of the lamp of the invention.
Figure 20:
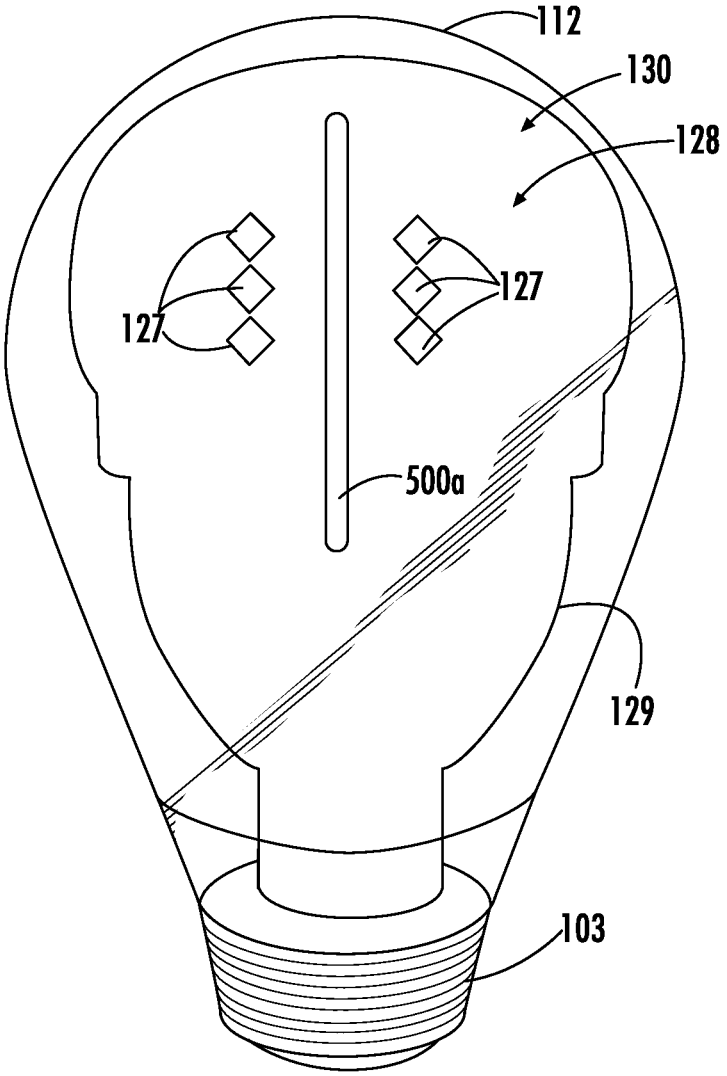

Referring to FIGS. 19 and 20 in some embodiments the LED assembly 130 may comprise an LED board 129 for supporting the LEDs 127 and a reflector board 500, 500*a* that does not support any LEDs and is used only to reflect light emitted from the LEDs 1127 on LED board 129. The reflector boards 500, 500*a* are mounted relative to the LED board 129 such that the reflector boards extend at an angle relative to the LED board to reflect at least a portion of the light emitted by the LEDs 127 on the LED boards. The reflector boards 500, 500*c* may extend at a right angle relative to the LED boards 129 or the reflector boards may extend at angles other than 90 degrees relative to the LED board to alter the light pattern of the lamp. As shown in FIGS. 19 and 20 the reflector board 500 is relatively small compared to reflector 500*a* such that more or less light may be reflected based on the size of the reflector. The direction and amount of reflected light may also be controlled by altering the reflective surface of the reflector boards to be diffuse, specular, refractive, spreading or the like. Using a reflector board that extends for less than the height of the LED board as shown for example in FIG. 19 allows some LEDs 127*a* to be disposed such that they emit light directly into two sectors of the lamp. Moreover the reflector boards may be sized and shaped in a manner similar to the LED boards 129 as previously described. For example in the embodiment of FIGS. 1-12 one of the LED boards 129 may be replaced by a reflector board 500 where the reflector board has the same size and shape as the LED board such that the reflector board and the LED board combine to define the sectors as previously described. In this and in other embodiments, one board may comprise an LED board and an adjacent board may comprise a reflector board having the same or a different configuration as the LED board. As used herein the term "board" is used to refer to either or both of a reflector board and a LED board where a LED board is a board as previously described that supports at least one LED and a reflector board is a board as previously described that is capable of reflecting light but that does not support a LED.

Figure 21A:
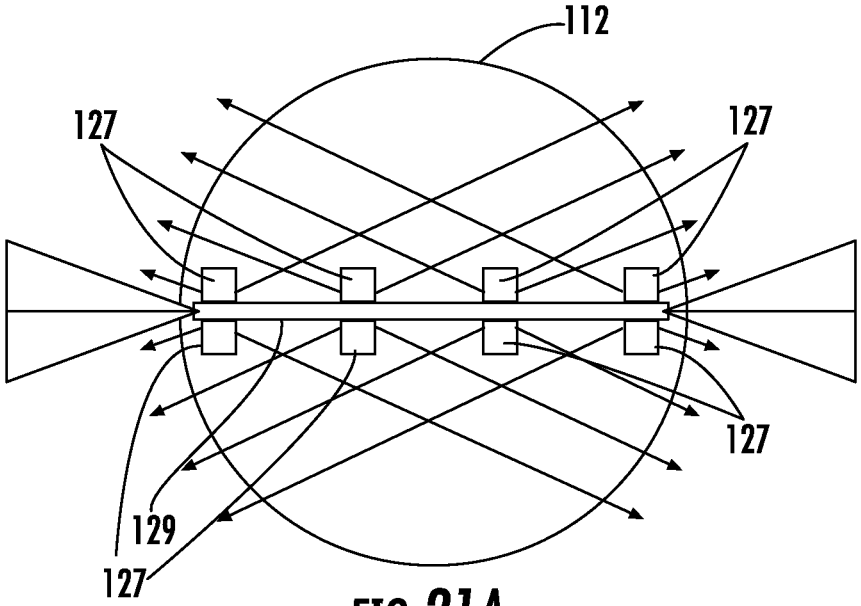
FIGS. 21*a* and 21*b* are schematic views showing example light patterns.
Figure 21B:
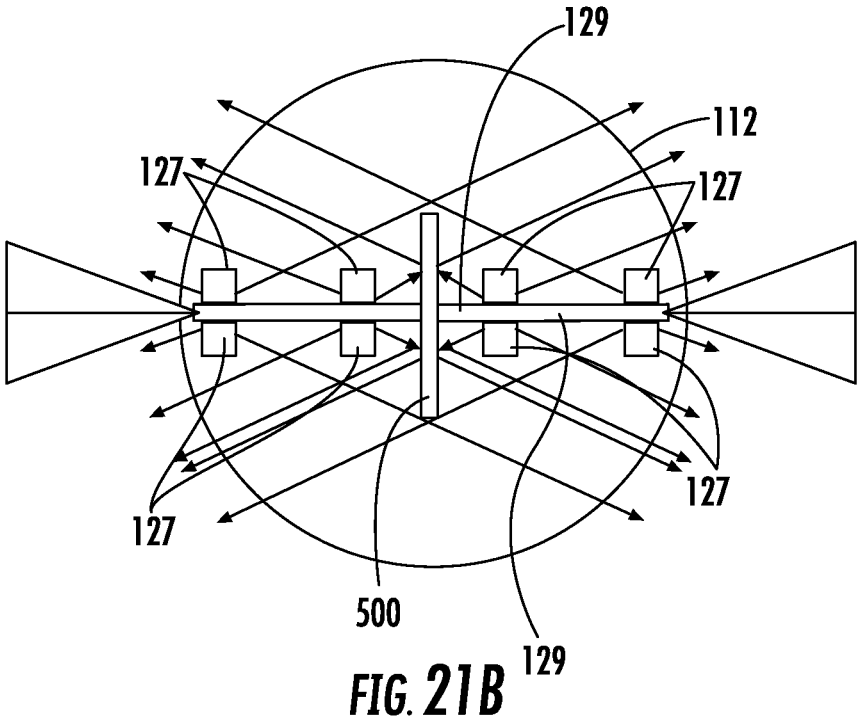

FIGS. 21*a* and 21*b* show schematically the effect of using a LED assembly as described herein. FIG. 21*a* shows a lamp with a planar LED board and no reflector or second LED board. The red arrows show an exemplary light pattern of the lamp. FIG. 21*b* shows a similar lamp with a reflector 500. As shown in FIG. 21*b* more light may be emitted to the sides of the lamp using the reflector 500 or the LED boards used as reflectors as previously described.

Figure 22:
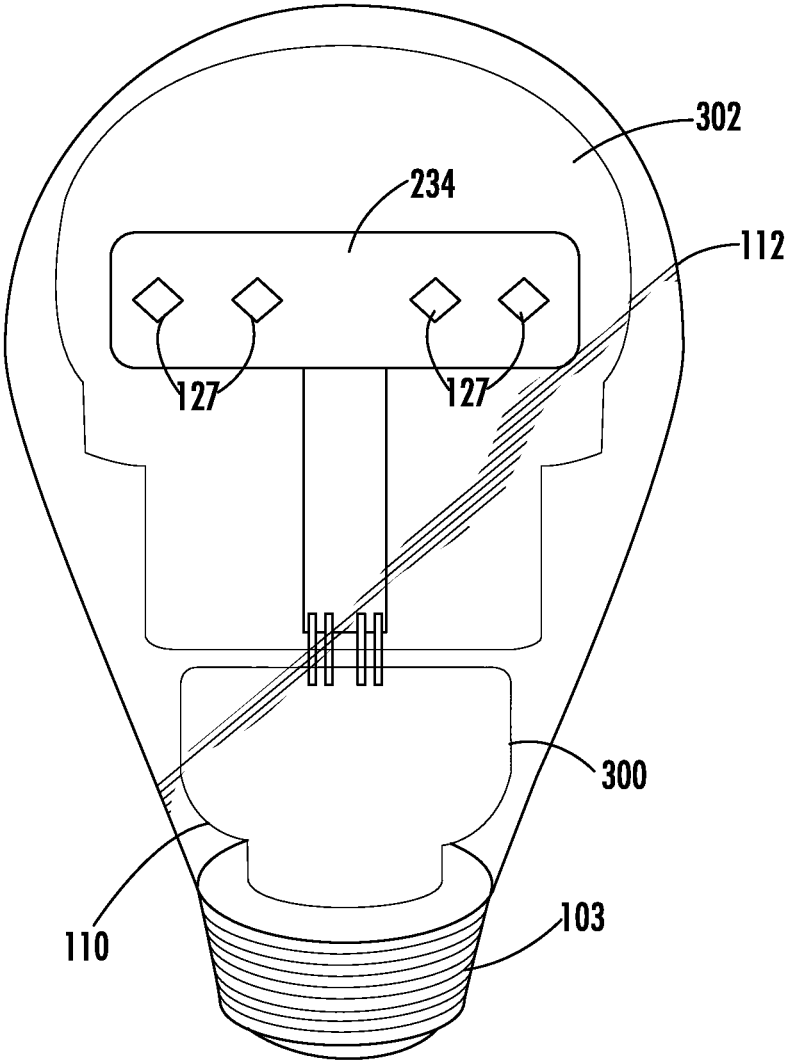
FIG. 22 is a schematic view of another alternate embodiment of the lamp of the invention.
Figure 23:
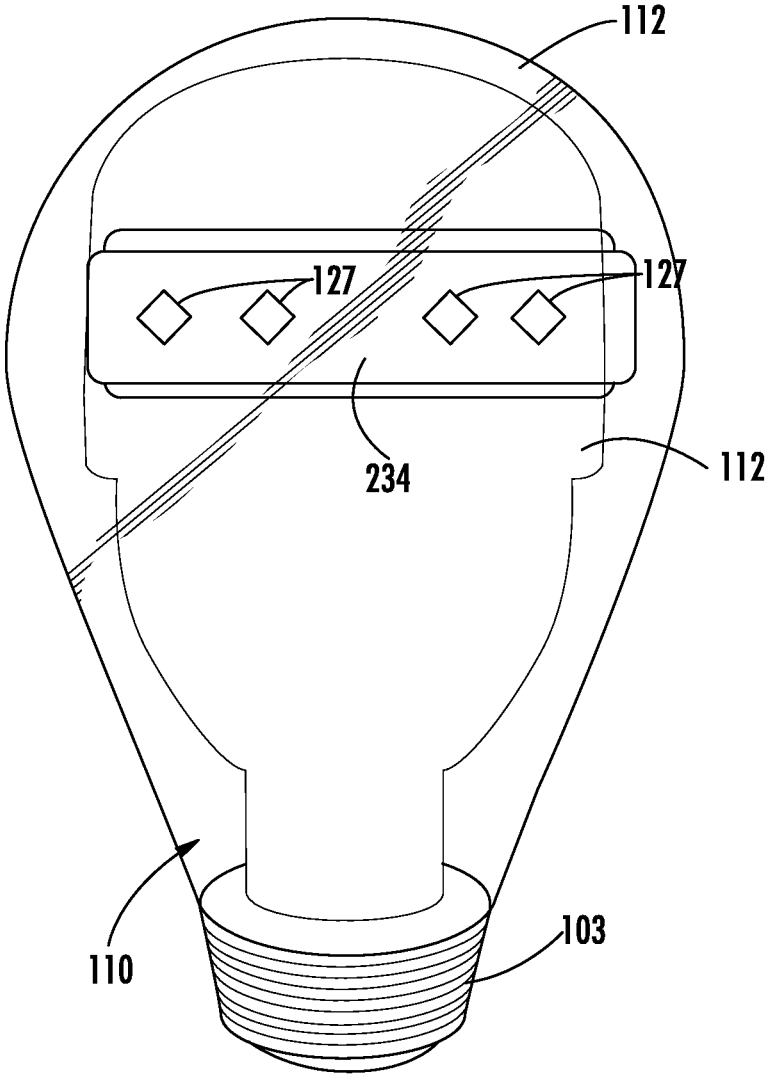
FIG. 23 is a schematic view of yet another alternate embodiment of the lamp of the invention.
Figure 24:
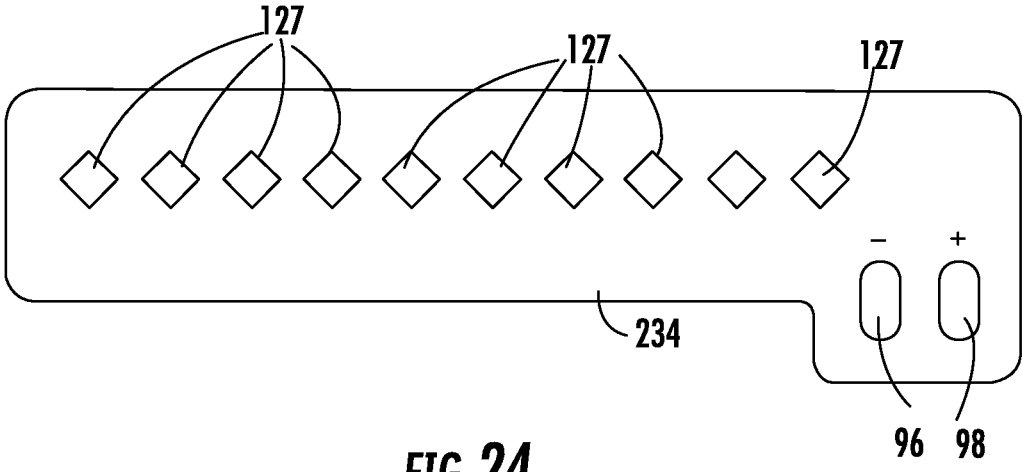
FIGS. 24 and 25 are schematic views of embodiments of LED assemblies usable in the lamp of the invention.
Figure 25:
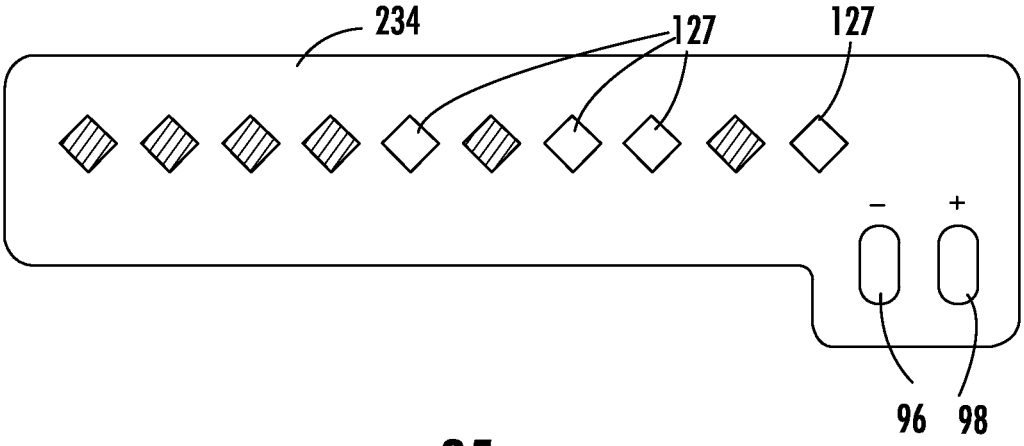

FIG. 22 shows an embodiment of a two-piece LED board as previously described with respect to FIG. 14 with an electrical interconnect used to connect the lamp electronics 110 to the LED board 302. A flex circuit may be used to support the LEDs and provide the electrical path from the electrical interconnect to the LEDs. FIG. 23 is an embodiment of a single LED board 129 without a reflector or a reflective LED board. A flex circuit may be used to support the LEDs and provide the electrical path from the electrical interconnect to the LEDs. FIGS. 24 and 25 are examples of flex circuits usable in the lamp of the invention that may be provided with multiple positions for the LEDs and anode side and cathode side contacts 96, 98 for connecting the flex circuit to the electrical path.

Figure 26:
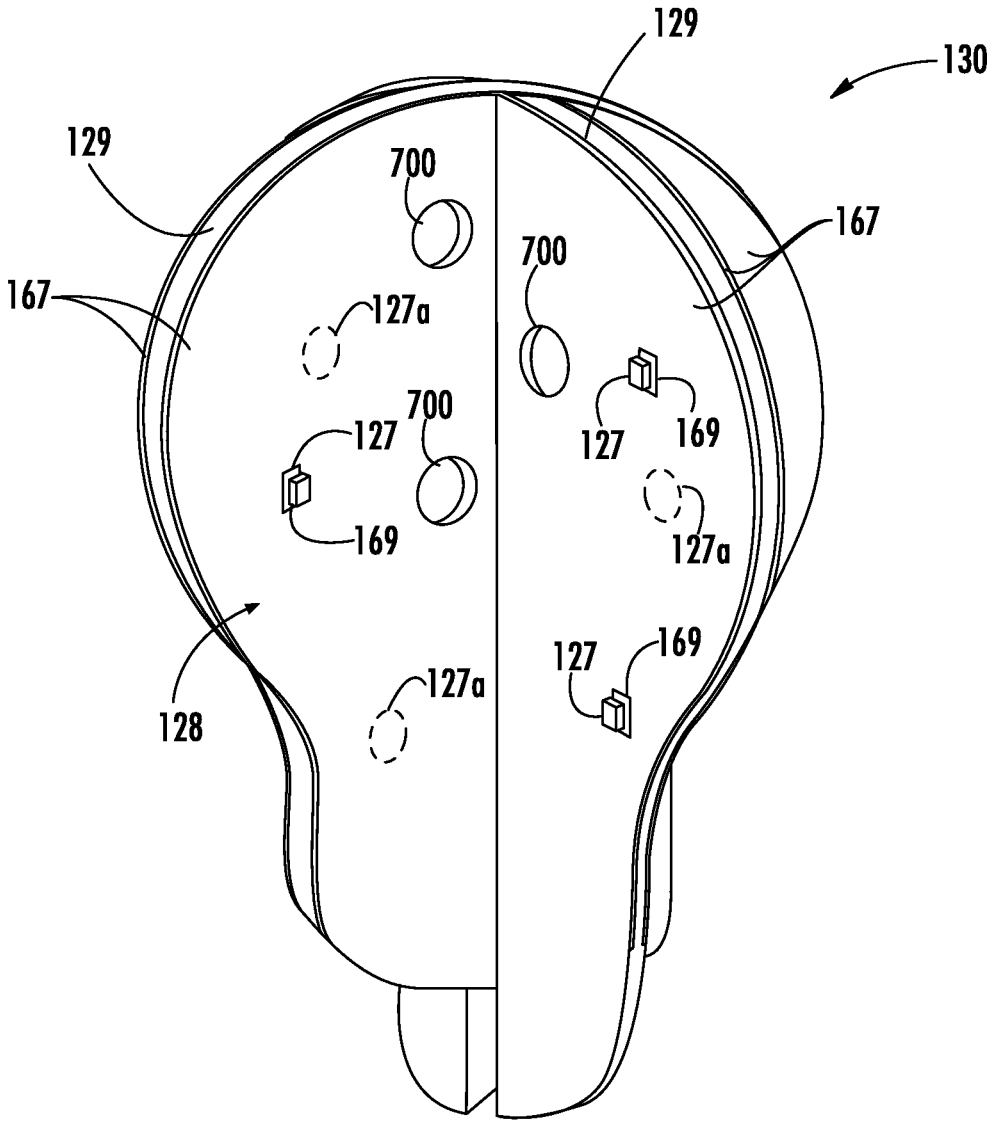
FIG. 26 is a perspective view of an embodiment of an LED assembly usable in the lamp of the invention.

Referring to FIG. 26 in some embodiments the LED boards 129 may be provided with openings, apertures, notches or the like 700 that provide light conduits through the LED boards 129 that allow some light to pass through the LED boards. In one embodiment, the apertures may be located near the intersection of the LED boards 129 to improve light uniformity.

In some embodiments an antenna 600 may be provided in the bulb for receiving, and/or transmitting, a radio signal or other wireless signal between the lamp and a control system and/or between lamps. The antenna 600 may convert the radio wave to an electronic signal that may be delivered to the lamp electronics 110 for controlling operation of the lamp. The antenna may also be used to transmit a signal from the lamp. The antenna 600 may be positioned inside of the enclosure 112 such that the base 102 including Edison screw 103 do not interfere with signals received by or emitted from antenna 600. While the antenna is shown in the enclosure 112, the antenna may be located in the enclosure 112 and/or base 102. The antenna may also extend entirely or partially outside of the lamp. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety.

In some embodiments color control is used and RF control circuitry for controlling color may also be used in some embodiments. The lamp electronics may include light control circuitry that controls color temperature of any of the embodiments disclosed herein in accordance with user input such as disclosed in U.S. patent application Ser. No. 14/292,286, filed May 30, 2014, entitled "Lighting Fixture Providing Variable CCT" by Pope et al. which is incorporated by reference herein in its entirety.

In other embodiments of the lamp, a directional lamp 1100 may be provided that may be used as a replacement for an incandescent directional bulb such as BR bulb, such as a BR30 or similar bulb, a PAR bulb or other similar reflector bulb as shown in FIG. 17. The lamp 1100 of the invention includes a base 102 that may comprise an Edison connector 103 and a housing 105 as previously described. The enclosure 1112 may be connected to base 102. Enclosure 1112 may comprise an interior surface that defines reflector 1114 that reflects light in a desired pattern. The reflector 1114 may be a parabolic reflector such as found in a PAR style bulb for reflecting the light in a relatively tight pattern or the reflector 1114 may have other shapes such as conical or faceted for reflecting the light in a wider pattern such as may be found in a BR style bulb. The reflector 1114 may be formed as part of the enclosure 1112 or it may be formed as a separate component positioned inside of the enclosure. The reflector 1114 may be formed on the inside of the transparent plastic or glass enclosure and may be for example made of a reflective aluminum layer. The reflector 1114 may be an opaque plastic component made of reflective white material or it may be a specular surface located inside of the enclosure 1112. In a reflector lamp such as a PAR or BR style lamp the interior reflector reflects at least a portion of the light emitted by the LEDs 127 in the desired pattern out of exit surface 1116. Numerous configurations of both standard and nonstandard lamps may be provided. Other constructions of the reflective surface and enclosure are possible.

In the directional lamp 1100 of FIG. 17, the LED assembly 1130 is positioned in the enclosure 1112. The LEDs 127 and reflected light sources 127*a* direct some light directly out of the exit surface 1116 of the lamp. Light that is not emitted directly out of the exit surface may be reflected by the reflector 1114 toward the exit surface 1116 such that the light is projected from the lamp 100 in a desired directional beam. A secondary reflector may be provided to reflect light toward the exit surface 1116. Vents or apertures 1108 and 1109 may be provided to allow air flow through the enclosure and over the LED assembly 1130.

Figure 27:
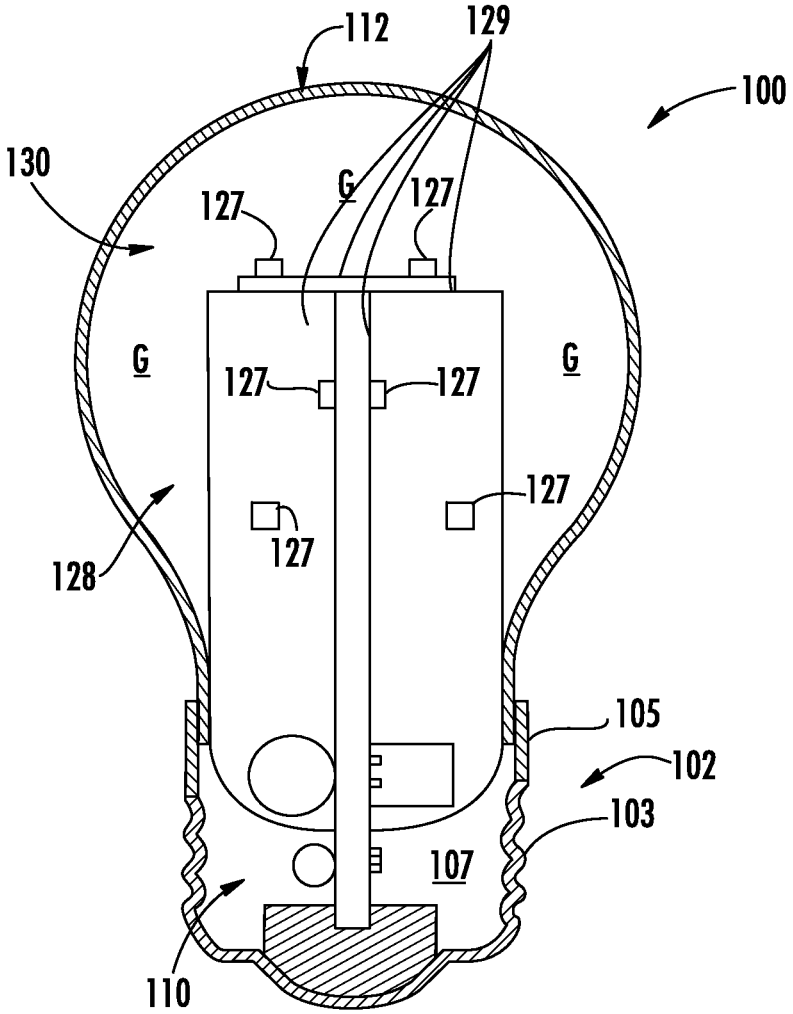
FIG. 27 is a section view of another embodiment of the lamp of the invention.
Figure 28:
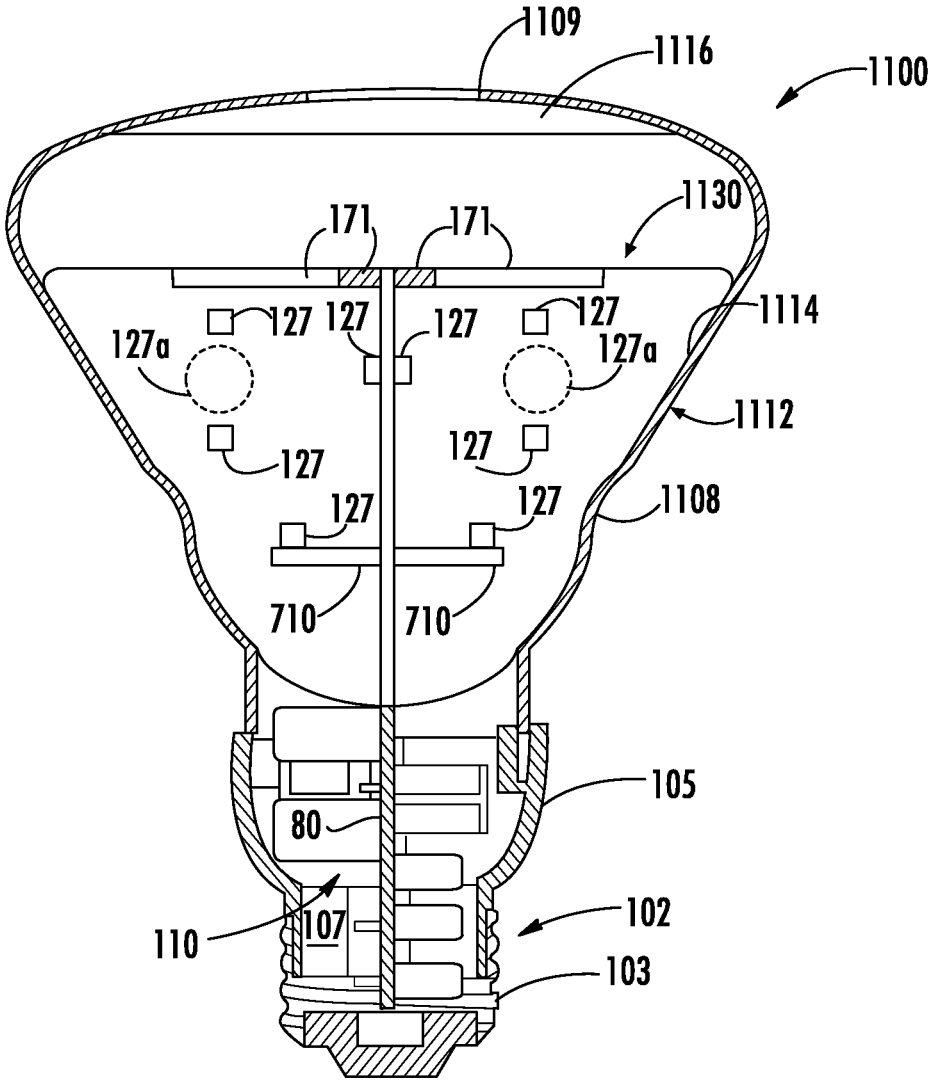
FIG. 28 is a section view of another embodiment of the lamp of the invention.

Referring to FIGS. 27 and 28, in some embodiments, one or more LED boards 129 may be arranged vertically as previously described. An additional LED board 710 may be arranged horizontally such that at least one LED 127 may be arranged on the top surface of the horizontal LED board 710 to direct light primarily toward the distal end of the lamp. Such a horizontal board may be used in a directional lamp such as a BR or PAR style lamp or it may be used in an omnidirectional lamp such as an A-series style lamp. The horizontal LED boards 710 may be located in different positions inside of enclosures 112, 1112 to create different light patterns.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

a base;

at least one LED board extending from the base to define at least a first sector and a second sector;

at least one first LED located in the first sector and at least one second LED located in the second sector, the at least one first LED and the and at least one second LED operable to emit light when energized through an electrical path from the base;

a first lens disposed over the at least one first LED and a second lens disposed over the art least one second LED where the first lens and the second lens and the at least one LED board are exposed to the exterior of the lamp.

2. The lamp of claim 1 wherein the first lens and the second lens comprises a diffuser.

3. The lamp of claim 1 wherein the first lens and the second lens comprises a phosphor.

4. A lamp comprising:

an at least partially optically transmissive enclosure defining an interior space having an interior surface having a shape and comprising vent openings that provide communication between the interior space and an exterior of the lamp;

an electrically conductive base connected directly to the enclosure;

at least one LED board having a peripheral edge and dividing the interior space into at least two sectors, wherein the peripheral edge extends to the interior surface and conforms to the shape of the interior surface such that the at least two sectors are bounded by the at least one LED board and a portion of the enclosure;

at least one LED located in each of the at least two sectors in the enclosure and operable to emit light when energized through an electrical path from the base wherein a portion of the enclosure is defined by a partition internal of the enclosure and lamp electronics are disposed in the enclosure between the partition and the base.

5. The lamp of claim 4 wherein the base comprises an Edison screw and the enclosure comprises a plastic enclosure.

6. The lamp of claim 4 wherein the inside surface of a portion of the enclosure adjacent the Edison screw is mechanically diffusive to prevent visibility through the portion.

7. The lamp of claim 4 wherein the enclosure comprises a plastic enclosure having a polished finish exterior surface and a mechanically diffusive interior surface.

8. The lamp of claim 4 further comprising a reinforcement member connecting the at least one LED board to the enclosure.

9. The lamp of claim 4 wherein the at least one LED board is electrically coupled to the base by a first spring contact and a second spring contact.

10. A lamp comprising:

an at least partially optically transmissive enclosure having an interior surface having a shape and defining an interior space;

a base connected to the enclosure;

a first LED board and a second LED board dividing the interior space into at least two sectors, the first LED board comprising at least a first a peripheral edge and the second LED board comprising at least a second peripheral edge where the at least a first peripheral edge and the at least a second peripheral edge have a length and extend to the interior surface over substantially the length of the at least a first peripheral edge and the at least a second peripheral edge where the at least a first peripheral edge and the at least second peripheral edge conform to the shape of the interior surface of the optically transmissive enclosure over substantially the length of the at least a first peripheral edge and the at least a second peripheral edge;

at least one first LED mounted on the first LED board and located in one of the at least two sectors and at least one second LED mounted on the second LED board and located in another one of the at least two sectors, the at least one first LED and the at least one second LED being operable to emit light when energized through an electrical path from the base.

11. The lamp of claim 10 wherein the base consists of an Edison screw and the enclosure comprises a plastic enclosure that is connected directly to the Edison screw.

12. The lamp of claim 11 wherein the inside surface of a portion of the enclosure adjacent the Edison screw is mechanically diffusive to prevent visibility through the portion.

13. The lamp of claim 12 wherein the portion of the enclosure is defined by a partition internal of the lamp.

14. The lamp of claim 13 wherein lamp electronics are disposed between the partition and the Edison screw.

15. The lamp of claim 10 wherein the enclosure comprises a plastic enclosure having a polished finish exterior surface and a mechanically diffusive interior surface.

16. The lamp of claim 10 wherein the enclosure comprises vent openings.

17. The lamp of claim 10 further comprising a reinforcement member connecting the first LED board to the second LED board.

18. The lamp of claim 17 wherein the enclosure comprises vent openings and the reinforcement member comprises blockers positioned internally of the enclosure that prevent direct line of sight to the at least one LED though the vent openings.

19. The lamp of claim 18 wherein the blockers are light diffusive.

20. The lamp of claim 10 further comprising a reinforcement member connecting the first LED board and the second LED board to the enclosure.

21. The lamp of claim 10 wherein the first LED board and the second LED board divide the interior space into four sectors where two LEDs are located in each sector a first one of the two LEDs in each sector located on the first LED board and a second one of the two LEDs in each sector located on the second LED board.

22. The lamp of claim 10 wherein the first LED board is electrically coupled to the base by a first spring contact.

23. The lamp of claim 10 wherein the first LED board is electrically coupled to the second LED board by a second spring contact.

* * * * *